US008135316B2

(12) United States Patent
Kojima et al.

(10) Patent No.: US 8,135,316 B2
(45) Date of Patent: Mar. 13, 2012

(54) DEVELOPMENT ROLLER, DEVELOPMENT DEVICE, PROCESS CARTRIDGE AND IMAGE FORMING DEVICE

(75) Inventors: Toshio Kojima, Isehara (JP); Kyohta Koetsuka, Fujisawa (JP); Noriyuki Kamiya, Yamato (JP); Rei Suzuki, Atsugi (JP); Tadaaki Hattori, Hadano (JP); Yoshiyuki Takano, Hachiohji (JP); Masayuki Ohsawa, Atsugi (JP); Hiroya Abe, Yokohama (JP); Takashi Innami, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/643,221

(22) Filed: Dec. 21, 2009

(65) Prior Publication Data

US 2010/0158578 A1 Jun. 24, 2010

(30) Foreign Application Priority Data

Dec. 24, 2008 (JP) ..... 2008-327036

(51) Int. Cl.
*G03G 15/09* (2006.01)

(52) U.S. Cl. ..... 399/276; 399/279; 399/286

(58) Field of Classification Search ..... 399/276, 399/239, 279, 286
See application file for complete search history.

(56) References Cited

U.S. PATENT DOCUMENTS

| | | | | |
|---|---|---|---|---|
| 4,301,583 | A * | 11/1981 | Poole | 492/35 |
| 4,389,113 | A * | 6/1983 | Matsumoto et al. | 399/231 |
| 5,522,786 | A * | 6/1996 | Fields et al. | 492/33 |
| 6,681,092 | B2 * | 1/2004 | Terai | 399/267 |
| 6,810,227 | B2 * | 10/2004 | Sakata et al. | 399/281 |
| 7,356,295 | B2 * | 4/2008 | Imamura | 399/286 |
| 7,466,947 | B2 * | 12/2008 | Zemba | 399/276 |
| 7,751,760 | B2 * | 7/2010 | Koike et al. | 399/285 |
| 2009/0060591 | A1 * | 3/2009 | Kojima et al. | 399/276 |
| 2010/0143007 | A1 * | 6/2010 | Eun et al. | 399/286 |
| 2011/0129262 | A1 * | 6/2011 | Nakamoto | 399/286 |

FOREIGN PATENT DOCUMENTS

| | | | |
|---|---|---|---|
| JP | 2002304052 | A * | 10/2002 |
| JP | 2003-255692 | | 9/2003 |
| JP | 2004-191835 | | 7/2004 |
| JP | 2007-86091 | | 4/2007 |
| JP | 2008-39933 | | 2/2008 |
| JP | 2008-139585 | | 6/2008 |
| JP | 2009-80447 | | 4/2009 |

OTHER PUBLICATIONS

English machine translation of Japanese document Kusano et al. (JP 2002-304052).*

* cited by examiner

*Primary Examiner* — David Gray
*Assistant Examiner* — Geoffrey Evans
(74) *Attorney, Agent, or Firm* — Cooper & Dunham LLP

(57) ABSTRACT

An image forming device comprises a process cartridge. The process cartridge comprises a development roller. The development roller comprises a magnet roller and a developing sleeve 132. The magnet roller is fixed. The depressions 139 each having an oval shape are formed on the external surface of the developing sleeve 132. Both ends of the depressions 139 which are adjacent with each other along the longitudinal direction of the developing sleeve 132 are overlapped with each other and both ends of the depressions 139 which are adjacent with each other along the circumferential direction of the developing sleeve 132 are spaced with each other.

17 Claims, 20 Drawing Sheets

DEVELOPMENT ROLLER, DEVELOPMENT DEVICE, PROCESS CARTRIDGE AND IMAGE FORMING DEVICE

CROSS-REFERENCE TO THE RELATED APPLICATION

This application is based on and claims the priority benefit of Japanese Patent Application No. 2008-327036, filed on Dec. 24, 2008, the disclosure of which is incorporated herein by reference in its entirety.

BACKGROUND

1. Technical Field

This disclosure relates to a development roller used for copying machines, facsimiles, printers or the like, more specifically to a development roller which includes a development sleeve disposed adjacently to a photo-conductive drum and a magnetic roller disposed in the development sleeve and in which a developer including a toner and a magnetic carrier is adsorbed to an outer surface of the development sleeve by a magnetic force of the magnet roller, a surface treatment device configured to treat the outer surface of the development sleeve, and a wire member used to roughen the outer surface of the development sleeve.

2. Description of Related Art

According to the prior art, in order for the developing sleeve of the development roller of the development device to carry the developer and surely convey the developer to the photo-conductive drum, the sand blast processing and so on are executed on an external surface of the developing sleeve described above (For example, see the Patent Documents 1 to 3 described below), or the grooves are formed on the external surface of the developing sleeve, or the linear material is randomly collide with the external surface by the rotating magnetic field, what is called, the electromagnetic blast processing has been executed on the external surface of the developing sleeve.

By performing the sand blast processing described above or forming the depressions, the developer slips and is stagnant on the external surface of the developing sleeve which rotates at high speed, and the developer also prevents the deterioration in the density of the images.

Although the developing sleeve on which the above-described sand blast processing is performed is composed of any of aluminum alloy, brass, stainless steel, and electrically conductive resin, it often is comprised of aluminum alloy in order to reduce the cost and enhance the processing precision. In the case where the external surface of the developing sleeve comprised of aluminum alloy is subjected to the sand blast processing, for example, an aluminum tube which is extruded into a developing sleeve-like extrusion at high temperature is subjected to the cold blowing of grindstone powder, thereby making the surface uneven.

The surface roughness is formed to a degree of Rz 5.0 to 15 μm. In the developing sleeve of which the external surface is subjected to the sand blast processing, if the developing sleeve rotates at high speed, the developer engages the uneven surface and thus the slippage is prevented from occurring. However, since the uneven portions formed on the external surface are very fine, the unevenness is gradually scraped away by the developer and so on. For this reason, the uneven portions of the developing sleeve subjected to the sand blast processing are scraped away to be flattened as the number of printed sheets increases or with the change over time. Thus, the developing sleeve subjected to the sand blast processing has a problem in that the conveying amount of the developer is gradually decreased and the thus formed images gradually become light-colored. As such, the developing sleeve subjected to the sand blast processing has a problem of endurance. Although it is possible for the developing sleeve to be made of stainless steel having a high hardness or to be subjected to the sand blast processing, they lead to cost increase and are thus not desirable.

Further, although the developing sleeve on which the above-described sand blast processing is performed is composed of any of aluminum alloy, brass, stainless steel, and electrically conductive resin, it is often comprised of aluminum alloy in order to reduce the cost and enhance the processing precision similar to the above. In the case where the external surface of the developing sleeve comprised of aluminum alloy is subjected to forming the depressions, for example, an aluminum tube which is extruded into a developing sleeve-like extrusion at high temperature is subjected to the cold extruding, thereby forming the depressions thereon by the dice. As the cross-sectional shape of each groove, a rectangular shape, V-shape, U-shape and so on are general. Further, the depth of each of the depressions in the order of 0.2 mm and the number of grooves in the order of 50 for the developing sleeve having an external diameter of ϕ25 mm are general.

In the developing sleeve of which the external surface is subjected to forming the depressions, if the developing sleeve rotates at high speed, the developer engages in the grooves and thus the slippage is prevented from occurring. Further, since the developing sleeve of which the external surface is formed with the depressions is considerably larger than the developing sleeve on which the sand blast processing is performed, the grooves are not likely to be worn away and the conveying amount of developer is never deteriorated. Namely, the developing sleeve of which the external surface is formed with the depressions is less worn away for use in the long-term as compared with the developing sleeve on which the sand blast processing is performed, thereby enabling the safe convey of the developer.

However, in the developing sleeve of which the external surface is formed with the depressions, since the amount of developer conveyed through the grooves is larger than the amount of developer conveyed through the portions being not formed with the depressions, the periodical variation in the image density due to the formation of the grooves or the variation in pitch tends to occur. Generally, although the deeper the grooves become, the larger the conveying amount of the developer, the variation in pitch by the differences of the developing electrical field strength and so on due to the formation of the grooves or not tends to occur. On the one hand, if the grooves are shallow, the variation in pitch does not tend to occur from the viewpoint of the developing electrical field strength. However, if the toner or an additive, or the carrier in the developer is/are filled, the deterioration degree of the conveying performance of the developer becomes large, the variation in pitch tends to occur due to the lack of the absorbing amount of the developer.

Now, as the solution to the above-described problems, JP2003-255692A (Patent Document 1) describes that the depth of each of the grooves is defined as not less than 0.05 mm and not more than 0.15 mm so as to prevent the variation in pitch from occurring and try to maintain the conveying performance of the developer. However, in recent years, in order to obtain a high quality image, since the image reproducibility is enhanced due to the progress of the image forming technology by the adoption of smaller particle diameter toner or smaller particle diameter carrier, the variation in pitch tends to conspicuously occur. For this reason, even if the image forming device disclosed in JP2003-255692A is adopted, there tends to occur the variation in pitch.

The reason for this will be reviewed. As shown in FIGS. 33 and 34, in the development region D where the developing sleeve 200 and the photo-conductive drum 201 face each other, on the external surface of the developing sleeve 200 on which grooves 202 are not formed, the developer 203 slips and thus the amount of developer 203 is reduced. This was due to the deterioration in density (density). In general, although the developer 203 moves in the development region D where the developing sleeve 200 and the photo-conductive drum 201 face each other, it is necessary to convey a large quantity of developer 203 so as to obtain the sufficient image density.

For this reason, usually, the development sleeve 200 is driven to rotate by the surface speed which is 1.1 to 2.5 times larger than that of the photo-conductive drum 201. When the developer 203 rotates at high speed and passes through the development region D, the friction of the developer 203 with the photo-conductive drum 201 which rotates at relatively low speed becomes a load resistance. On the external surface of the developing sleeve 132 where grooves are not formed, as shown in FIG. 33, the slippage of the developer 203 or the lack of the absorbing amount of the developer tends to occur. For this reason, in the development region D, the amount of developer in the downstream side compared with that in the upstream side along the rotating direction of the developing sleeve 200 is reduced. On the one side, as shown in FIG. 34, since the sufficient conveying force can be obtained while the depressions pass through the development region D, the slippage does not occur and the absorbing amount of the developer is sufficient. Namely, in a period of the grooves 202 which pass through the development region D, the amount of the developer 203 varies depending upon whether the slippage occurs or not and the variation in pitch due to the difference of image density occurs.

JP2004-191835A (Patent Document 2) proposes an image forming device in which the toner of which a volumetric average particle diameter of not less than 4 μm and not more than 8.5 μm is used as the developer on the external surface of the developing sleeve is formed with a plurality of grooves which extend along the longitudinal direction of the developing sleeve, and the interval between the depressions which are adjacent with each other is adapted to be smaller than the traveling direction width of the photo-conductive drum in the development region where the developer contacts the photo-conductive drum. According to this image forming device, there always exists at least one groove of the developing sleeve, the groove suppressing the slippage of the developer which is carried on the developing sleeve. Thus, it is possible to suppress the variation in the amount of the developer in the development region as compared with the case where no grooves of the developing sleeve exist in the development region. Whereby, even if the toner having volumetric average particle diameter of not less than 8.5 μm is used, it is possible to form a high quality image having good image reproducibility and not to make the variation in pitch due to the difference of image density stand out.

According to the developing sleeve disclosed in JP2004-191835A described above, it is necessary to make the interval between the grooves narrower. The method in which an aluminum tube is subjected to the cold extruding and then forming the grooves thereon by the dice has reached the limit. Even if further grooves are processed in the interval between the grooves in which additional grooves are possible to be formed, since the deviation in the depth of each of the grooves increases in the cutting process or the grinding process as external diameter finishing, the variation in image density of the deviation in the depth of each of the grooves occurs.

On the one hand, in the processing method in which one groove or a plurality of grooves is/are simultaneously formed or cut as a method of forming depressions, although it is possible to make the interval between the grooves narrower or to reduce the deviation of the depth of each of the grooves, nevertheless, the number of processes is increased and thus such an increase leads to cost increase of the product.

Further, JP2007-86091 (Patent Document 3) discloses an electromagnetic blast processing by which it is possible to suppress the deterioration in the conveying amount of the developer due to the change over time, but since the linear material randomly collides with the external surface of the developing sleeve, it is difficult to set up the process condition capable of achieving the long life span while ensuring the optimal absorbing amount of the developer, and thus there arises a problem in that it is difficult to handle with the further increase of the absorbing amount of the developer in order to maintain the high quality in the future high speed machine.

In order to balance the suppression of a lowering of the conveying amount of the developer due to this kind of change over time and the prevention of the occurrence of the variation in pitch, the applicant of the present application proposes that the tip end of the end mill as the rotating tool which rotates around the axis of rotation thereof is abut against the external surface of the developing sleeve, the end mill and the developing sleeve are relatively moved along the longitudinal direction of the developing sleeve while rotating the developing sleeve around the axis of rotation of the developing sleeve, and the depressions are formed on the external surface of the developing sleeve so that both ends of the depressions which are adjacent with each other on the external surface of the developing sleeve are spaced with each other.

In the developing sleeve formed as described above, since such projections which are formed by the conventional sand blast processing are not formed and each of the depressions are formed larger than the projections which are formed by the conventional sand blast processing, the depressions are likely to be worn away by the change over time. Thus, it is possible to suppress the lowering of the conveying amount of the developer. Further, since a large number of the depressions are arranged in a spaced manner so that the depressions formed on the external surface are not overlapped with each other, the developer is collected in the depressions, so that the portions in which the developer is collected are formed on the external surface in a uniformly spaced manner. Accordingly, it is possible to prevent the variation in image from occurring.

However, in the developing sleeve on which external surface is formed with depressions by the end mill, if the roundness and the coaxiality of the sleeve prior to processing are low, the distance between the end mill and the external surface of the developing sleeve varies when processing the depressions. As such, if the distance between the end mill and the external surface of the developing sleeve varies, the planar shape of each of the depressions becomes larger or smaller. Thus, since large depressions and small depressions are unevenly distributed along the circumferential direction of the developing sleeve, the variation in conveying force of the developer occurs along the circumferential direction of the developing sleeve. Accordingly, one portions wherein the absorbing amount of the developer is large and the other portions wherein the absorbing amount of the developer is small when the developing sleeve rotates, are alternately occurred. Since the image density is dark in the portion where the absorbing amount of the developer is large and the image density is light in the portion where the absorbing amount of the developer is small, the variation in image density occurs.

It is necessary to make the deviation in depth of each of the depressions not more than 10 μm in order to prevent the variation in image density from occurring. For this reason, the developing sleeve prior to performing the surface treatment needs to have the roundness or the coaxiality of the high precision order such as not more than 10 μm, thus the developing sleeve is not available and this is not practical.

BRIEF SUMMARY

In an aspect of this disclosure, there is provided a development roller, development device, and a process cartridge equipped with the development roller, as well as an image forming device capable of suppressing the lowering of the conveying amount of the developer due to change over time and preventing variation in image density from occurring without using high precision material.

According to another aspect, there is provided a development roller comprising: a magnet roller, and a developing sleeve which contains the magnet roller and is configured to attract and absorb a developer on an external surface thereof by means of a magnetic force of the magnet roller, wherein a large number of depressions are formed on the external surface of the developing sleeve in a regular manner so that both ends of the depressions which are adjacent with each other along at least one of the longitudinal and circumferential directions of the developing sleeve overlap, each of the depressions being a circular shape or an oval shape viewed from a top.

According to another aspect, of the present invention, there is provided a development roller, in the above mentioned development roller, wherein the depressions are formed on the external surface of the developing sleeve so that both ends of the depressions which are adjacent with each other along the longitudinal direction of the developing sleeve are overlapped with each other and both ends of the depressions which are adjacent with each other along the circumferential direction of the developing sleeve are spaced with each other.

According to another aspect, the depressions are formed on the external surface of the developing sleeve so that both ends of the depressions which are adjacent with each other along the longitudinal direction of the developing sleeve are spaced with each other and the both ends of the depressions which are adjacent with each other along the circumferential direction of the developing sleeve are overlapped with each other.

According to another aspect, the depressions are formed in an oval shape viewed from the top and arranged so that the longitudinal direction of the depressions is parallel to the longitudinal direction of the developing sleeve.

According to another aspect, a cross section of each of the depressions along the circumferential direction of the developing sleeve is formed in a V shape and a cross section of each of the depressions along the longitudinal direction of the developing sleeve is formed in a circular shape.

According to another aspect, a cross section of each of the depressions along the circumferential direction of the development roller is formed in a circular shape and a cross section of each of the depressions along the longitudinal direction of the developing sleeve is formed in a V shape.

According to another aspect, wherein the depressions which are adjacent with each other along the circumferential direction of the developing sleeve are arranged at a position where is offset along the longitudinal direction of the developing sleeve.

According to another aspect, the depressions are arranged on the external surface of the developing sleeve in a spiral manner.

According to another aspect, each volume of the depressions is formed in a gradually increasing manner from a center of the developing sleeve along the longitudinal direction thereof to both ends thereof along the same direction.

According to another aspect, each depth of the depressions is formed in a gradually increasing manner from the center of the developing sleeve along the longitudinal direction thereof to both ends thereof along the same direction.

According to another aspect, each area of the depressions viewed from the top is formed in a gradually increasing manner from the center of the developing sleeve along the longitudinal direction thereof to both ends thereof along the same direction.

According to another aspect, each of the depressions is a depression that is formed by machining on the external surface of the developing sleeve by means of a rotating tool which is rotated around the axis of rotation thereof.

According to another aspect, each of the depressions is a depression that is formed by relatively moving the rotating tool and the developing sleeve along the longitudinal direction of the developing sleeve while the developing sleeve arranged in a state that it is crossing the axis of rotation of the rotating tool is rotated around the axis of rotation thereof.

According to another aspect of this disclosure, there is provided a development device comprising the aforementioned development roller which includes, on an external surface thereof, a developing sleeve for absorbing a developer.

According to another aspect of this disclosure, there is provided a process cartridge comprising the aforementioned developing device.

According to another aspect of this disclosure, there is provided an image forming device at least comprising a photo conductive drum, an electrically charging device, and the aforementioned developing device.

DETAILED DESCRIPTION OF THE PREFERRED EMBODIMENTS

A first embodiment of the present invention is described with reference to FIGS. 1 to 4 as follows.

Figure 1:
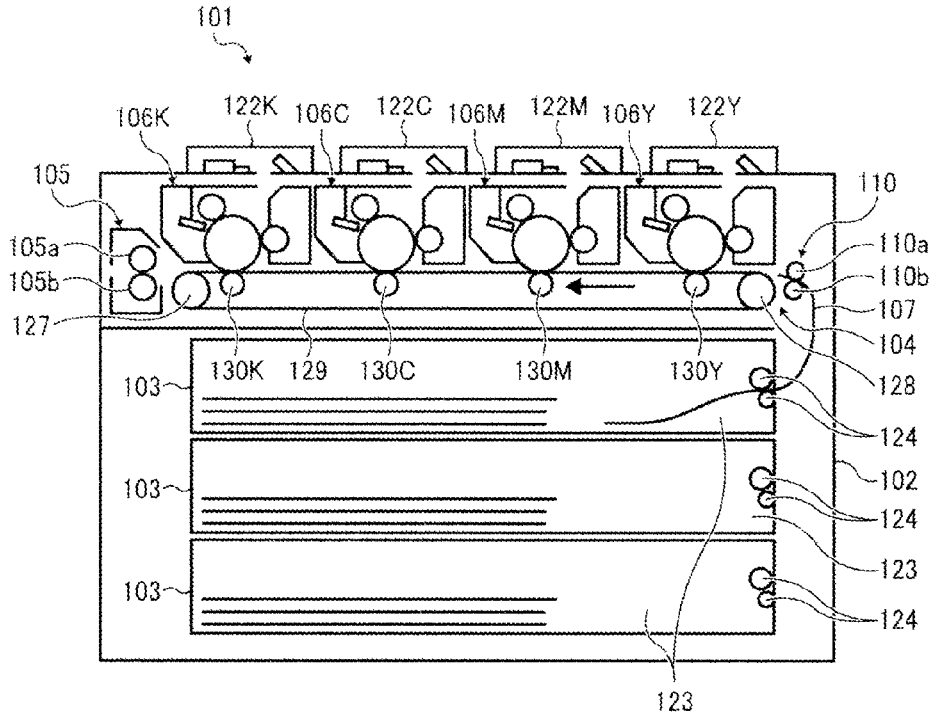
FIG. 1 is a front view illustrative of the arrangement of an image forming device comprising a developing sleeve according to a first embodiment of the present invention.
Figure 2:
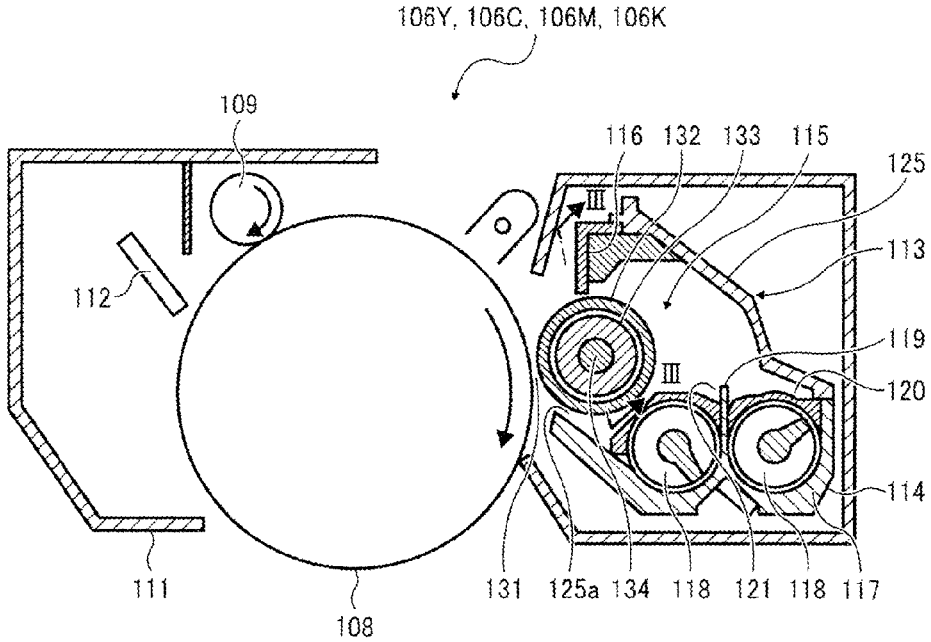
FIG. 2 is a cross sectional view illustrative of a process cartridge of the image forming device shown in FIG. 1.
Figure 3:
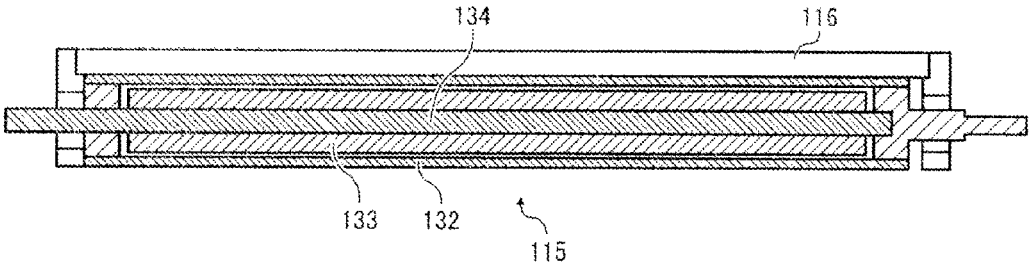
FIG. 3 is a cross sectional view taken on line III-III of FIG. 2.
Figure 4:
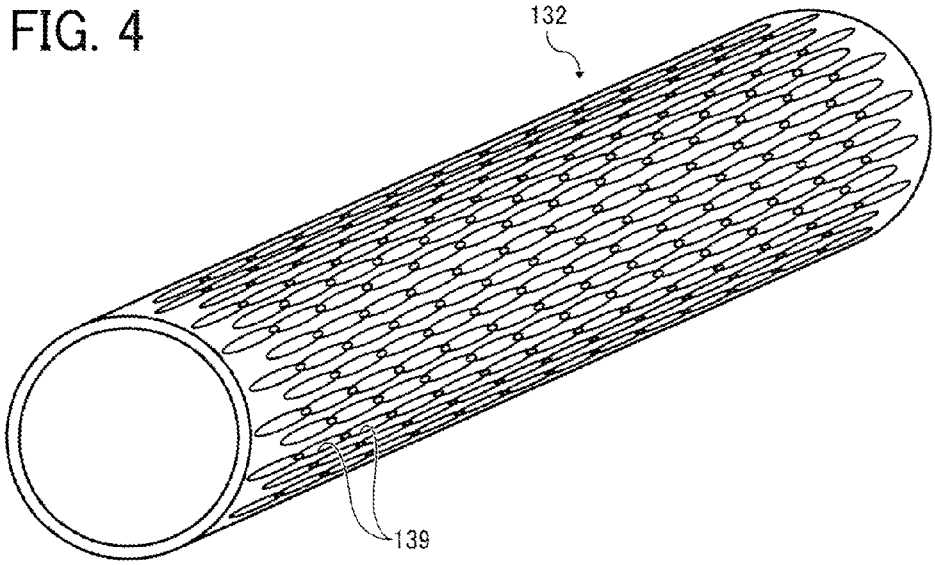
FIG. 4 is a perspective view illustrative of the developing sleeve of the image forming device shown in FIG. 1.

FIG. 1 is a sectional view showing a main part of an image forming apparatus according to the first embodiment of the present invention. FIG. 2 is a sectional view showing a development device of the image forming apparatus shown in FIG. 1 according to the first embodiment of the present invention. FIG. 3 is a sectional view as viewed along a line III-III of FIG. 2. FIG. 4 is an explanatory view showing an operating state of the development device shown in FIG. 2.

Figure 8:
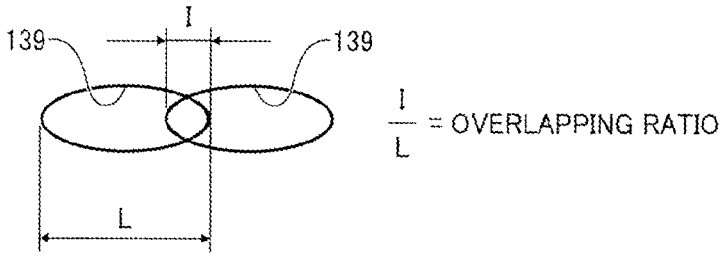
FIG. 8 is a schematic diagrammatic view illustrative of the relationship of the depressions which are adjacent with each other formed on the external surface of the developing sleeve shown in FIG. 6A.

The image forming apparatus 201 forms an image of each color of yellow (Y), magenta (M), cyan (C), black (K), that is to say, a color image on a recording paper 207 (see FIG. 8) as a transfer member. Here, each unit corresponding to the color of yellow, magenta, cyan, black is shown with Y, N, C, K suffixed to the reference number.

The image forming apparatus 101 includes at least a main body 102, a paper supplying unit 103, a resist roller pair 110, a transfer unit 104, a fixing unit 105, a plurality of laser writing units 122Y, 122M, 122C, and 122K, and a plurality of process cartridges 106Y, 106N, 106C, and 106K as shown in FIG. 1.

The main body 102 is for example formed in a box shape and mounted on a floor. The main body 102 contains the paper supplying unit 103, the resist roller pair 110, the transfer unit 104, the fixing unit 105, the plurality of laser writing units 122Y, 122M, 122C, and 122K, and the plurality of process cartridges 106Y, 106M, 106C, and 106K.

A plurality of paper supplying units 103 are provided on a lower portion of the main body 102. The paper supplying unit 103 houses the above-mentioned recording papers 107 which are stacked and includes a paper supplying cassette 123 which is capable of moving in and from the main body 102 and a paper supplying roller 124. The paper supplying roller 124 is compressed on the recording paper 107 which is positioned on a top in the paper supplying cassette 123. The paper supplying roller 124 sends the above-mentioned top recording paper 107 to a region between a mentioned-below conveying belt 129 of the transfer unit 104 and photo-conductive drums 108 of a mentioned-below development device of the process cartridges 106Y, 106M, 106C, and 106K.

The resist roller pair 110 is provided on a conveying line of the recording paper 107 from the paper supplying unit 103 to the transfer unit 104, and includes a pair of rollers 110*a*, 110*b*. The resist roller pair 110 pinches the recording paper 107 between the pair of rollers 110*a*, 110*b* and sends between the transfer unit 104 and the process cartridges 106Y, 106M, 106C, and 106K at a time when the pinched recording paper can be overlapped by the toner image.

The transfer unit 104 is provided upward of the paper supplying unit 103. The transfer unit 104 includes a driving roller 127, a driven roller 128, the conveying belt 129 and the plurality of transfer rollers 130Y, 130M, 130C, 130K. The driving roller 127 is disposed downstream of a conveying direction of the recording paper 107 and is rotated to be driven by a motor as a driving source, and so on. The driven roller 128 is supported to be capable of rotating on the main body 102 and is disposed upstream of the conveying direction of the recording paper 107. The conveying belt 129 is formed in an endless annular shape and is tacked across both of the driving roller 127 and the driven roller 128 mentioned above. The conveying belt 129 rotates clockwise around the driving roller 127 and the driven roller 128 mentioned above due to a rotate drive of the driving roller 127.

The conveying belt and the recording paper 107 on the conveying belt 129 are pinched between the transfer rollers 130Y, 130M, 130C, 130K and the photo-conductive drums 108 of the process cartridges 106Y, 160M, 160C, and 160K respectively. The transfer unit 104 allows the recording paper 107 sent from the paper supplying unit 103 to be compressed on each of outer surfaces of the photo-conductive drums 108 of process cartridges 106Y, 106M, 106C, and 106K and the toner image to be transferred on the recording paper 107. The transfer unit 104 sends the recording paper 107 where the toner image is transferred to the fixing unit 105.

The fixing unit 105 is provided downstream of the conveying direction of the recording paper 107 of the transfer unit 104 and includes a pair of rollers 105*a*, 105*b* which are pinching the recording paper 107 therebetween. The fixing unit 105 compresses and heats the recording paper 107 which is sent from the transfer unit 104 and passed between the pair of rollers 105*a*, 105*b* to fix the toner image transferred from the photo-conductive drum 108 to the recording paper 107 thereon.

The laser writing units 122Y, 122M, 122C, and 122K are mounted on upper portions of the main body 102, respectively. The laser writing units 122Y, 122M, 122C, and 122K correspond to the process cartridges 106Y, 106M, 106C, and 106K, respectively. The laser writing units 122Y, 122M, 122C, and 122K irradiate the outer surfaces of the photo-conductive drums 108 which are charged uniformly by charged rollers 109 (mentioned below) of the process cartridges 106Y, 106M, 106C, and 106K with laser light to form the electrostatic latent image.

The plurality of process cartridges 106Y, 106M, 106C, and 106K are provided between the transfer unit 104 and the laser writing unit 122Y, 122M, 122C, and 122K. The process cartridges 106Y, 106M, 106C, and 106K are removably provided on the main body 102. The process cartridges 106Y, 106M, 106C, and 106K are provided in parallel with each other along the conveying direction of the recording paper 107.

The process cartridges 106Y, 106M, 106C, and 106K include at least a cartridge case 111, the charged roller 109 as a charging device, the photo-conductive drum 108 as a photo conductor (also referred to as an image supporting body), a cleaning blade 112 as a cleaning device, and a development device 113 as shown in FIG. 9. Therefore, the image forming apparatus 101 includes at least the charged roller 109, the photo-conductive drum 108, the cleaning blade 112, and the development device 113.

The cartridge case 111 is detachably disposed on the main body 102 and contains the charged roller 109, the photo-conductive drum 108, the cleaning blade 112, and the development device 113. The charged roller 109 charges uniformly the outer surface of the photo-conductive drum 108. The photo-conductive drum 108 is disposed with an interval from a development roller 115 (mentioned below) of the development device 113. The photo-conductive drum 108 is formed in a cylindrical or tube-like shape to be capable of rotating about an axis. The photo-conductive drum 108 provides the electrostatic latent image thereon by the corresponding laser writing unit 122Y, 122M, 122C, and 122K. The photo-conductive drum 108 is developed by attaching a toner on the electrostatic latent image which is formed and supported on the outer surface, and transfers the obtained toner image to the recording paper 107 positioned between the conveying belt 129 and the photo-conductive drum 108. The cleaning blade 112 removes a toner remaining on the outer surface of the photo-conductive drum 108 after transferring the toner image onto the recording paper 107.

The development device 113 includes at least a developer supplying portion 114, a case 125, the development roller 115 as a developer supporting body, and a control blade 116 as a control member as shown in FIG. 2.

The developer supplying portion 114 includes a containing tank 117 and a pair of agitating screws 118 as an agitating member. The containing tank 117 is formed in a box shape of almost the same length as the photo-conductive drum 108. Provided in the containing tank 117 is a partition wall 119 lengthening in a longitudinal direction of the containing tank 117. The partition wall 119 partitions the containing tank 117 into a first space 120 and a second space 121. The first space 120 and the second space 121 communicate with each end.

The developer 126 is contained in both the first space 120 and the second space 121 of the containing tank 117. The developer 126 includes the toner and a magnetic carrier (also referred to as magnetic powder). The toner is accordingly provided to one end of the first space 120 which is a side away from the development roller 115 of the first and second spaces 120 and 121. A toner particle is formed in a spherical particle prepared by an emulsion polymerization method or a suspension polymerization method. In addition, the toner may be prepared by crushing a mass of synthetic resin obtained by mixing and dispersing various types of dye and colorant. An average diameter of the toner particles is within a range of 3 μm to 7 μm. Further, the toner may be formed by a crushing process or the like.

The magnetic is contained in both of the first space 120 and the second space 121. The particle diameter of the magnetic carrier is within a range of 20 μm to 50 μm.

The agitating screws 118 are contained in the first space 120 and the second space 121, respectively. Longitudinal directions of the agitating screws 118 are in parallel to longitudinal directions of the containing tank 117, the development roller 115 and the photo-conductive drum 108.

The agitating screws 118 are disposed to be capable of rotating about axes to agitate the toner and magnetic carrier as well as to convey the developer 126 along the axes. In the illustrated embodiment, the agitating screw 118 in the first space 120 conveys the developer 126 from one end to the other end. The agitating screw 118 in the second space 121 conveys the developer 126 from the other end to one end.

According to the above-mentioned structure, the developer supplying portion 114 conveys the toner provided to one end of the first space 120 to the other end thereof while agitating with the magnetic carrier, and then conveys the same from the other end to the other end of the second space 121. The developer supplying portion 114 agitates the toner and the magnetic carrier in the second space 121, and then, provides them on an outer surface of the development roller 115 while conveying in an axial direction thereof.

The case 125 is formed in a box shape and mounted on the containing tank 117 of the above-mentioned developer supplying portion 114 to cover the development roller 115 as well as the containing tank 117 and so on. Furthermore, an opening 125*a* is provided on an opposing part to the photo-conductive drum 108 of the case 125.

The development roller 115 is formed in a cylindrical shape and provided between the second space 121 and the photo-conductive drum 108 and provided near the above-mentioned opening 125*a*. The development roller 115 is in parallel to both of the photo-conductive drum 108 and the containing tank 117. The development roller 115 is disposed with the interval from the photo-conductive drum 108. A space between the development roller 115 and the photo-conductive drum 108 makes a development area 131 to attach the toner of the developer 126 on the photo-conductive drum 108 thereby developing the electrostatic latent image and obtaining the toner image. In the development area 131, the development roller 115 is disposed to face the photo-conductive drum 108.

The development roller 115 includes a cored bar 134, a tube-like magnet roller (also, referred to as a magnet body) 133 and a tube-like developing sleeve 132 as a nonmagnetic tube-like body as shown in FIGS. 2 and 3. The cored bar 134 is disposed in a longitudinal direction thereof in parallel to the longitudinal direction of the photo-conductive drum 108, and fixed on the above-mentioned case 125 without rotating.

The magnet roller 133 comprises a magnetic material and is formed to a cylindrical shape, and a plurality of fixed magnetic poles (not shown) are mounted thereon. The magnet roller 133 is fixed on an outer periphery of the cored bar 134 without rotating about the axis of rotation.

The fixed magnetic poles are magnets each formed in a long and rod-like shape and mounted on the magnet rollers 133. The fixed magnetic poles are extended in the longitudinal direction of the magnet roller 133 or the development roller 115, and provided over an entire length of the magnet roller 33. The magnet roller 133 having the structure mentioned above is housed (contained) in the developing sleeve 132.

A single fixed magnetic pole is opposed to the above-mentioned agitating screw 118. The single fixed magnetic pole forms a picking-up magnetic pole and thus causes magnetic force to be generated on the outer surface of the developing sleeve 132, that is to say, of the development roller 115 so as to attract the developer 126 in the second space 121 of the containing tank 117 on the outer surface of the developing sleeve 132.

The other single fixed magnetic pole is opposed to the above-mentioned photo-conductive drum 108. The fixed magnetic pole forms a development magnetic pole, and causes magnetic force to be generated on the outer surface of the developing sleeve 132, that is to say, the development roller 115 to form magnetic field between the developing sleeve 132 and the photo-conductive drum 108. The fixed magnetic pole is configured to deliver the toner of the developer 126 which is attracted on the outer surface of the developing sleeve 132 on the photo-conductive drum 108 by forming a magnetic brush with the magnetic field.

At least one fixed magnetic pole is provided between the above-mentioned picking-up magnetic pole and the development magnetic pole. The fixed magnetic pole causes magnetic force to be generated on the outer surface of the developing sleeve 132, that is to say, the development roller 115 to convey a preceding developer 126 to the photo-conductive drum 108 and to convey a developed developer 126 from the photo-conductive drum 108 into the containing tank 117.

The above-mentioned fixed magnetic poles cause the magnetic carriers of the developer 126 to overlap along magnetic field lines generated by the fixed magnetic pole and form raised portions or ears on the outer surface of the developing sleeve 132 when attracting the developer 126 on the outer surface of the developing sleeve 132. As mentioned above, the state under which the magnetic carriers are overlapped along the magnetic field lines and raised on the outer surface of the developing sleeve 132 is referred to in the art as the raising of the magnetic carriers on the outer surface of the developing sleeve 132. Thus, the above-mentioned toner is attracted to the magnetic carriers. Namely, the developing sleeve 132 attracts the developer 126 on the outer surface thereof by the magnetic force generated by the magnetic roller 133.

The developing sleeve 132 is formed in a tube-like shape as shown in FIG. 4. The developing sleeve 132 is rotatably provided about the axis of rotation, containing the magnet roller 133. The developing sleeve 132 is rotated so that an inner surface of the developing sleeve 132 is opposed to the fixed magnetic poles. The developing sleeve 132 is made of a non-magnetic material, such as aluminum alloy, stainless steel (SUS), and so on. As mentioned above, the surface roughening treatment is performed on the outer surface of the developing sleeve 132 by the surface treatment device 151.

Aluminum alloy has advantageous effects such as its workability and its lightness. In the case that the aluminum alloy is used, A6063, A5056 and A3003 are preferred. In the case that SUS is used, SUS303, SUS304, and SUS316 are preferred. Further, in the illustrated embodiment, the developing sleeve 132 is composed of the aluminum alloy.

The outer diameter of the developing sleeve 132 is preferably on the order of 14 mm to 30 mm. The length of the developing sleeve 132 in the axial (axial center) direction is preferably on the order of 300 mm to 350 mm.

In addition, as shown in FIGS. 4, 5, 6A and 7, the external surface of the developing sleeve 132 is provided with a large number of depressions 139 each having an oval shape viewed from the top. Of course, the depressions 139 are formed on the external surface of the developing sleeve 132 with each longitudinal direction of the depressions 139 being arranged along the longitudinal direction of the developing sleeve 132. Namely, the depressions 139 are arranged with each longitudinal direction thereof being parallel or substantially parallel to the longitudinal direction of the developing sleeve 132. Meanwhile, in the illustrated embodiments, the longitudinal direction of each of the depressions 139 is arranged slightly inclined or substantially parallel to the longitudinal direction of the developing sleeve 132. In this way, according to the present invention, the longitudinal direction of each of the depressions 139 being arranged parallel to the longitudinal direction of the developing sleeve 132 includes the longitudinal direction of each of the depressions 139 being arranged parallel or substantially parallel to the longitudinal direction of the developing sleeve 132.

Figure 5:
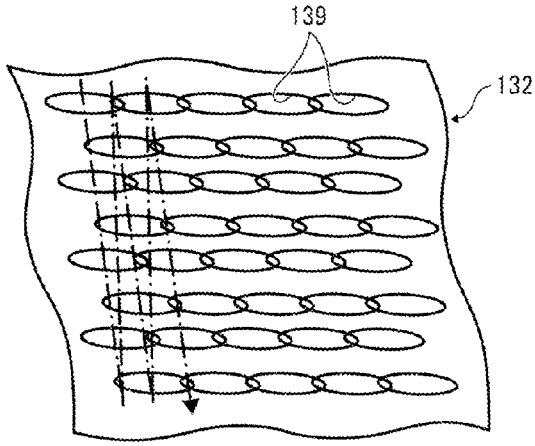
FIG. 5 is a schematic view illustrative for developing an external surface of the developing sleeve shown in FIG. 4.
Figure 6A:
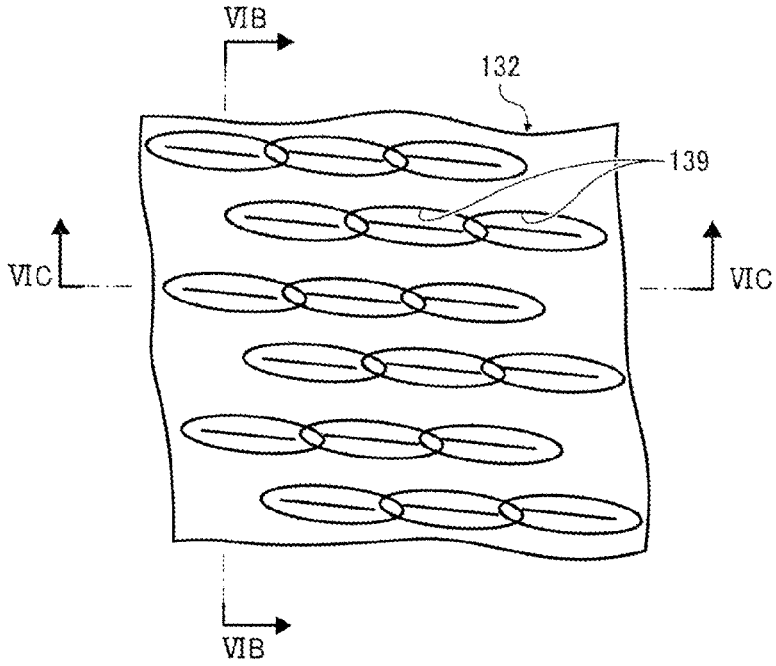
FIG. 6A is a schematic enlarged view illustrative of a portion of the external surface of the developing sleeve shown in FIG. 5.
Figure 7:
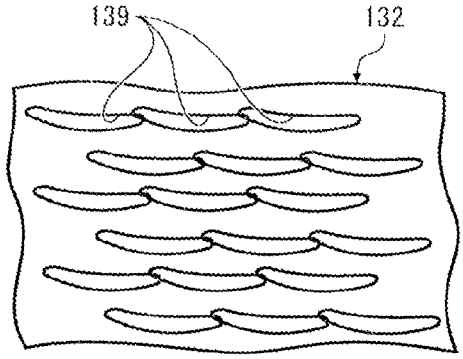
FIG. 7 is an enlarged view illustrative of the portion of the developing sleeve shown in FIG. 4.

Further, a large number of the depressions 139 are arranged along the longitudinal direction of the developing sleeve 132, as shown in FIGS. 5, 6A and 7. Ones among the depressions 139 which are adjacent with each other in the circumferential direction of the developing sleeve 132 are arranged with the ones being offset with each other by the degree of a half length of each of the depressions 139. Meanwhile, since the depressions 139 are formed on the external surface of the developing sleeve 132 by means of the surface treatment device 1 shown in FIG. 11A, the depressions 139 are arranged on the external surface of the developing sleeve 132 or in a spiral manner as shown in dot-dash lines in FIG. 5.

Further, a large number (plurality) of the depressions 139 described above are arranged in a regular manner so that ones among the depressions 139 which are adjacent with each other in the longitudinal direction of the developing sleeve 132 are overlapped with each other. In the illustrated embodiments, ones among the depression 139 which are adjacent with each other in the longitudinal direction of the developing sleeve 132 are arranged with their ends being overlapped with each other and the other ones which are adjacent with each other in the circumferential direction of the developing sleeve 132 are arranged with they being spaced with each other by a predetermined interval. Meanwhile, in the illustrated embodiments, the depressions 139 being arranged in a regular manner includes that the depressions 139 are arranged so that ones among the depressions 139 which are adjacent with each other in the circumferential and longitudinal directions of the developing sleeve 132 are arranged with their interval being a constant. Here, the interval of the ones among the depressions 139 is an interval between the centers of the ones of the depressions 139, viewed from the top. Namely, the interval between the ones among the depressions 139 which are adjacent with each other in the circumferential and longitudinal directions of the developing sleeve 132 is adapted to be constant. Meanwhile, in the illustrated embodiments, the depressions 139 being arranged in an irregular manner include the depressions 139 being arranged so that ones among the depressions 139 which are adjacent with each other in the circumferential and longitudinal directions of the developing sleeve 132 are arranged with their interval being not a constant.

As an example in which the depressions 139 are arranged in a regular manner, there is a case where the depressions 139 are arranged at the same pitch (interval) in a single-row spiral manner and in a circumferential direction of the developing sleeve 132, as shown in FIG. 5. Further, in the embodiment described above, the case in which the depressions 139 may be arranged in a two or more row spiral manner is similar thereto.

Further, the overlapping ratio in the longitudinal direction of the depressions 139 of which ends are overlapped with each other in the longitudinal direction of the developing sleeve 132 is defined as shown in the Equation (1) as follows.

$$(l/L)\times 100\% \qquad \text{Equation (1)}$$

Figure 9A:
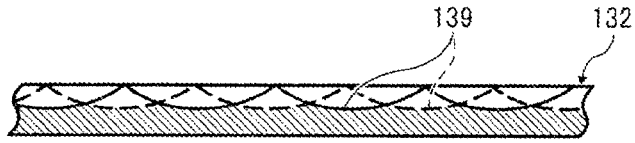
FIG. 9A is a schematic cross sectional view illustrative of the depressions which are adjacent with each other shown in FIG. 8 when the overlapping ratio is 50%.
Figure 9B:
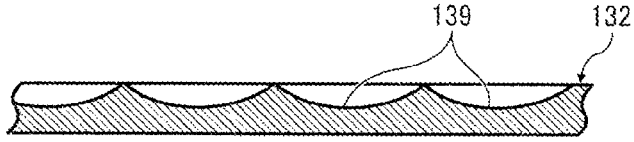
FIG. 9B is a schematic cross sectional view illustrative of the depressions which are adjacent with each other shown in FIG. 8 when the overlapping ratio is 0%.

Herein, L denotes a longitudinal length of a certain one of the depressions 139, along the developing sleeve 132 on which the depressions 139 are formed. l denotes a longitudinal length of a portion of the developing sleeve 132 where ones among the depressions 139 which are adjacent with each other overlap with each other. These L and l denote sizes formed on the external surface of the developing sleeve 132 if the developing sleeve 132 is formed to a complete cylindrical shape and the completed cylindrical developing sleeve 132 has an ideal shape without manufacturing errors. As an example, FIG. 9A shows a cross section in the longitudinal direction of the developing sleeve 132 in the case where the overlapping ratio in the longitudinal direction as described above is 50%. FIG. 9B shows a cross section in the longitudinal direction of the developing sleeve 132 in the case where the overlapping ratio in the longitudinal direction as described above is 0%.

In the case where the overlapping ratio in the longitudinal direction described above is low, when the roundness or the coaxiality of the developing sleeve 132 is low and each length of the depressions 139 is varied, there is a possibility of a problem occurring where a portion of both ends of ones among the depressions 139 are not overlapped on the external surface of the developing sleeve 132. In the case where both ends of the ones among the depressions 139 are overlapped and the other portion(s) of the ones among the depressions 139 are spaced (not overlapped), variation in the feeding power of the developer 126 occurs in the circumferential direction of the developing sleeve 132, as a result, variation occurs in the density in the thus formed image. For this reason, if the length of each of the depressions 139 is varied, in order to ensure the overlap of the ends of the ones among the depressions 139, it is desirable that the overlapping ratio in the longitudinal direction be larger than 10%. Because, if the overlapping ratio in the longitudinal direction is less than 10%, one portion(s) occurs where both ends of the ones among the depressions 139 are overlapped and the other portion(s) occurs where both ends of the ones among the depressions 139 are spaced (not overlapped).

Figure 10:
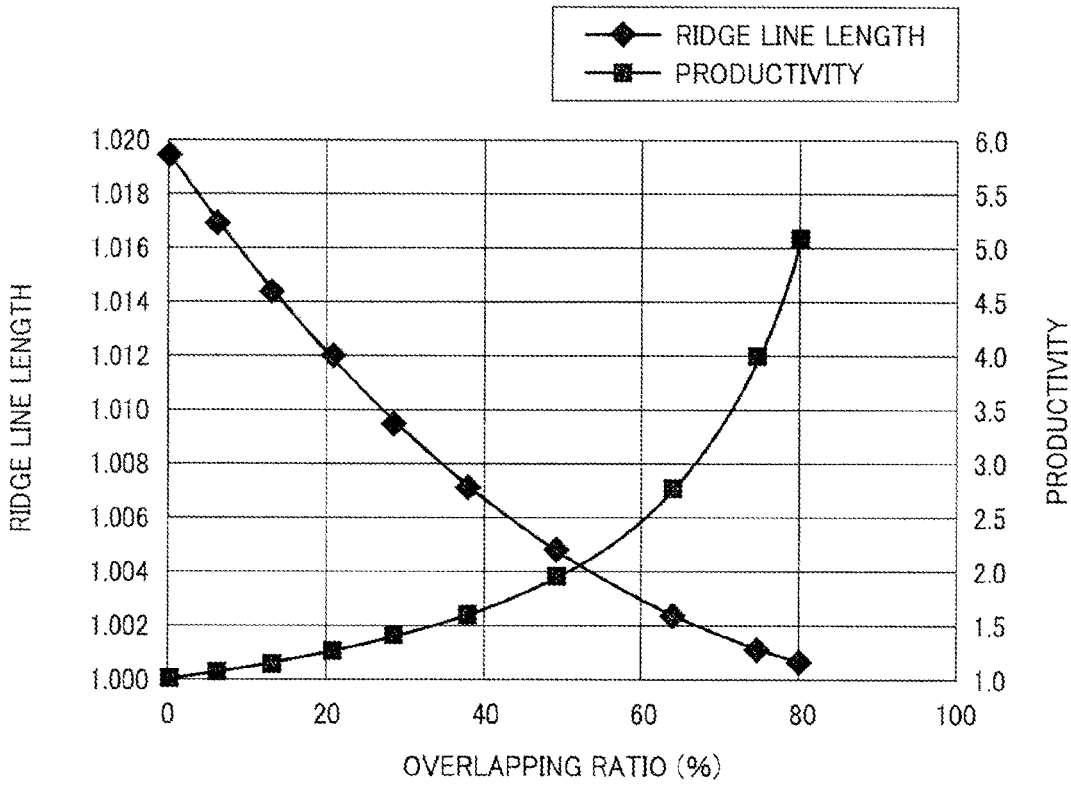
FIG. 10 is a graph illustrative of the variation in ridge line length and the productivity versus the variation in the overlapping ratio of the depressions which are adjacent with each other shown in FIG. 8.

Further, if the overlapping ratio in the longitudinal direction is set to a large value, the length of the bottom of each of the depressions 139 in question (hereinafter, refer to the length of each of the ridge lines) over a plurality of the depressions 139 becomes shorter. As a result, a time required for machining by means of the surface treatment device 1 shown in FIG. 11 becomes larger and thus the productivity is lowered. For example, FIG. 10 shows the relationship between the overlapping ratio, the length of the ridge lines and the productivity, when forming the depressions 139 each having the depth of 0.08 mm, formed by means of an end mill 21 having an external diameter of 2 mm. One of the vertical axes shows a length of each of the ridge lines. Herein, a time required for machining in order to show the productivity in the case where the overlapping ratio in the longitudinal direction is zero % (no overlaps exist), is defined as a value of 1.0. The other of the vertical axes shows the productivity. Herein, a length of each of the ridge lines in the case where the overlapping ratio in the longitudinal direction is 100% (no overlaps exist), is defined as a value of 1.0. Namely, FIG. 1 shows the relationship between the length of each of the ridge lines and the variation in productivity when the overlapping ratio in the longitudinal direction varies. According to FIG. 10, if the overlapping ratio in the longitudinal axis exceeds 50%, the variation of each of the ridge lines becomes smaller, a time for machining quickly increases, and the productivity decreases. Accordingly, the overlapping ratio in the longitudinal direction is preferably larger than 50%. Taking the above into account, in the present invention, it is preferable to define the overlapping ratio in the longitudinal ratio from the various view points.

Figure 6B:
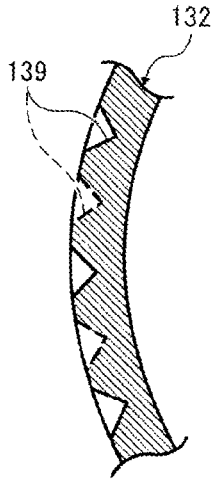
FIG. 6B is a cross sectional view taken on line VIB-VIB of FIG. 6A.
Figure 6C:
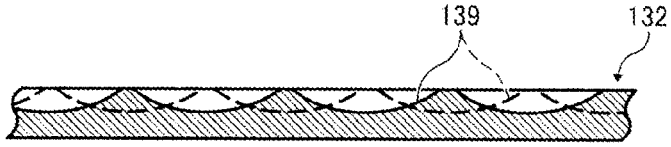
FIG. 6C is a cross sectional view taken on line VIC-VIC of FIG. 6A.

Further, the cross section in its widthwise direction of each of the depressions 139 is formed to a V-shape (namely, in the circumferential direction of the developing sleeve 132), as shown in FIG. 6B. As shown in FIG. 6C, the cross section in its longitudinal direction of the same is formed to a circular arc shape (namely, in the longitudinal direction of the developing sleeve 132). Further, since the depressions 138 are formed on the external surface of the developing sleeve 132 by means of the surface treatment device 1 shown in FIG. 11A, each of the depressions 139 is slightly arced in its longitudinal direction. Meanwhile, in the present invention, if the length of each of the depressions 139 is longer than the width of each of the same and each outer edge of the same is constituted of a curved line, each shape of the depressions 139 is generally regarded as an oval shape even if each shape of the same is constituted of a straight line or slightly arced in its longitudinal direction.

Further, the length in the longitudinal direction (lengthwise diameter) of each of the depressions 139 is not less than 0.3 mm and not more than 2.3 mm. The width in the transverse direction (widthwise diameter) of the same is not less than 0.1 mm and not more than 0.7 mm and the depth of the same is not less than 0.03 mm and not more than 0.15 mm. The developing sleeve 132 has depressions 139 of 50 to 500 or so per its external surface area of 100 $mm^2$. Namely, the total volume of a plurality (large number) of the depressions 139 is not less than 0.5 $mm^3$ and not more than 7.0 $mm^3$ per the external surface area of 100 $mm^2$ of the developing sleeve 132. Furthermore, the developing sleeve 132 is formed on the external surface thereof with the depressions 139 of not less than 1.0 and not more than 3.0 per 1 mm in the circumferential direction of the photo-conductive drum 108 which rotates together with the developing sleeve 132. Meanwhile, in FIGS. 5, 6A, and 7, left and right directions therein correspond to the longitudinal direction of the developing sleeve 132.

Generally, the deeper the depressions 139, the more the conveying performance of the developer 126 is enhanced. However, similar to the prior art developing sleeve on which external surface grooves are formed, periodical pitch variation tends to occur. On the other hand, when the depressions 139 are shallower, periodical pitch variation does not tend to occur. However, the conveying performance of the developer 126 is lowered. Particularly, in recent years, since image reproducibility is enhanced due to the progress of image forming technology regarding toner of small particle diameter and the magnetic carrier, the progress of close developing technology and the like, the pitch variation tends to occur. Thus, in the developing sleeve 132 described above, the improvement of the performance in feeding the developer and the prevention of the occurrence of the pitch variation are intended to be balanced by setting the depth of each of the depressions 139 to be shallower than usual and increasing the distribution density of the depressions 139 in question. Further, since there are not portions where the depressions 139 in question are not formed between the ones among the depressions 139 arranged along the longitudinal direction by overlapping the ends of the ones among the depressions 139 which are adjacent with each other in the longitudinal direction of the developing sleeve 132 even if the dimensional precision such as the roundness, the coaxiality and the like of the developing sleeve 132 is low, the conveying performance of the developer is increased. Thereby, even if the depressions 139 are formed to be shallower than usual, it is possible to obtain the conveying force of the developer 126 as desired. If the depressions 139 are formed to be shallower than usual, since the electrical field strength is lessened between the portions formed with the depressions 139 and other portions not formed with the depressions 139, it is possible to obtain a high quality image.

The doctor blade or the control blade 116 is provided at an end portion of the development device 113, the end portion being close to the photo-conductive drum 108. The control blade 116 is attached to the case 125 described above with the control blade 116 being spaced from the external surface of the developing sleeve 132. The control blade 116 peels down the developer 126 which is on the external surface of the developing sleeve 132 and beyond a predetermined thickness into the container 117 and the control blade 116 adjusts the thickness of the developer 126 on the external surface of the developing sleeve 132, the developer 126 being conveyed to the developing area 131, to the predetermined thickness.

The development device 113 having the foregoing structure sufficiently mixes the toner and the magnetic carriers in the developer supply unit 114, and causes the thus mixed developer to be attracted and adhered to the external surface of the developing sleeve 132 by means of the fixed magnetic poles. Then, the development device 113 conveys the developer which is attracted and adhered to the developing sleeve 132 with the rotation of the developing sleeve 132 and the attraction and adhesion of the developer to the developing sleeve 132, toward the developing area 131. The development device 113 causes the developer, which has been made to have the desired thickness by the control blade 116, to be attracted and adhered to the photo-conductive drum 108. In this way, the development device 113 carries the developer on the development roller 115, conveys the developer to the development area 131, and forms a toner image by developing an electrostatic latent image on the photo-conductive drum 108.

Thereafter, the development device 113 removes the developer after development to the container 117. Then, the developer after development contained in the container 117 is again sufficiently mixed with the other remaining developer in the second space 121, and is used for developing electrostatic latent images on the photo-conductive drum 108. When a below-described toner density sensor detects that a density of the toner which is supplied by the developer supply unit 114, for example, to the photo-conductive drums 108 is lowered, the developing device 113 is configured to feed the toner toward the development roller 115 by the driven rotation of the stir screw 118.

The image forming apparatus 101 having the foregoing structure forms an image on the recording sheet 107 in the following manner. Firstly, the image forming apparatus 101 rotates the photo-conductive drums 108, and uniformly charges the external surfaces of the photo-conductive drums 108 with the charging rollers 109 down to −700V. An electrostatic latent image is formed on the external surface of the photo-conductive drum 108 by irradiating a laser beam on the external surface of the photo-conductive drum 108 and attenuating an image part down to −150V due to the exposure of the photo-conductive drum 108. Thereafter, when the electrostatic latent image is positioned in the development area 131, a developing bias voltage down to −550V is applied to the electrostatic latent image and the developer adhering to the external surface of the developing sleeve 132 in the development device 113 is attracted and adheres to the external surface of the photo-conductive drum 108, thereby developing the electrostatic latent image and forming the toner image on the external surface of the photo-conductive drum 108.

After that, the image forming apparatus 101 transfers the toner images formed on the external surfaces of the photo-conductive drums 108 to the recording sheet 107 when the recording sheet 107 conveyed by the sheet feeding roller 124 of the sheet feeding unit 103 and the like is positioned between the photo-conductive drums 108 of the process cartridges 106Y, 106M, 106C and 106K and the conveyance belt 129 of the transfer unit 104. In the image forming apparatus 101, the fixation unit 105 fixes the toner image on the recording sheet 107. In this way, the image forming apparatus 101 forms a color image on the recording sheet 107.

Meanwhile, the toner which is not transferred and remains on the photo-conductive drum 108 is collected by the cleaning blade 112. The photo-conductive drum 108 of which the remaining toner is removed is initialized by means of a cleaning section discharge lamp (not shown) and provided to the next process.

In the image forming device described above, process control is performed in order to suppress the variation in image due to the environmental variation or the change over time. More specifically, first of all, the developing ability of the development device 113 is detected. For example, an image of a certain toner pattern is formed on the photo-conductive drum 108 under the condition that the developing bias voltage is made constant and the image density thereof is detected by the optical sensor (not shown), as a result, the development capability is grasped from the variation in density. Accordingly, it is possible to maintain the image quality to be constant by changing the target value of the toner density so that the development ability achieves the predetermined targeted development capability. For example, if the image density of the toner pattern is thinner than the targeted development density, in order to increase the toner density, the CPU as the control means (not shown) controls the driving circuit of the motor by which the agitating screws are driven to rotate. On the other hand, if the image density of the toner pattern detected by the optical sensor is thicker than the targeted development density, in order to lower the toner density, the CPU controls the driving circuit of the motor described above. Herein, the toner density is detected by the density sensor (not shown). Meanwhile, the image density of the toner pattern formed on the photo-conductive drum 108 more or less varies due to the effect of the variation in periodical image density caused by the developing sleeve 132.

Figure 11A:
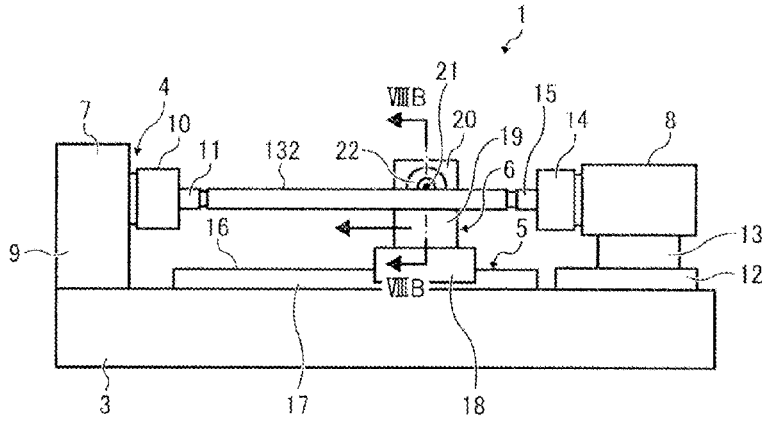
FIG. 11A is a schematic side view illustrative of the arrangement of a surface treatment apparatus by which a cutting process is executed on the external surface of the developing sleeve shown in FIG. 4.

The developing sleeve 132 described above is formed with the depressions 139 on the external surface thereof by means of the surface treatment device 1 shown in FIG. 11A.

The surface treatment device 1 includes a base 3, a holding portion 4, a motor 2 as a rotating driving portion, a tool moving portion 5 as a moving device, a tool 6, and a controller (not shown) as a controlling device, as shown in FIG. 11A.

The base 3 is formed in a tabular shape and mounted on a floor of a factory, on a table, and so on. An upper surface of the base 3 is held in parallel to a horizontal direction. The planar base 3 is formed in a rectangular shape.

The holding portion 4 includes a fixing holding portion 7, and a slide holding portion 8. The fixing holding portion 7 includes a fixing support 9 raised from an end portion of the base 3, and a rotating chuck 10 provided on an upper end portion of the fixing support 9. The rotating chuck 10 is formed in a thick disk shape and is rotatably supported at the upper end portion of the fixing support 9 around the axis of rotation of the rotating chuck 10. The axis of rotation of the rotating chuck 10 is disposed parallel to the surface of the base 3. In a center portion of the rotating chuck 10, a cylindrical chuck pin 11 is raised therefrom. Of course, the chuck pin 11 is disposed in a coaxial relationship with the rotating chuck 10.

The slide holding portion 8 includes a slider 12, a slider support 13, and a rotating chuck 14 provided on an upper end portion of the fixing support 9. The slider 12 is slidably mounted along a surface of the base 3 or the axis of rotation of the chuck pin 11 of the rotating chuck 10. Further, the slider 12 is configured so that a position along the axis of rotation of the chuck pin 11 of the rotating chuck 10 is appropriately fixed.

The slider support 13 is raised from the slider 12. The rotating chuck 14 is formed in a thick disk shape and is mounted on the output shaft of the motor 2 attached to an upper end portion of the slider support 13. The axis of rotation of the rotating chuck 14 is disposed in a coaxial relationship with the chuck pin 11 of the rotating chuck 10 of the fixing holding portion 7. In a center portion of the rotating chuck 14, a cylindrical chuck pin 15 is raised therefrom. Of course, the chuck pin 15 is disposed in a coaxial relationship with the rotating chuck 14.

The developing sleeve 132 prior to being formed with the depressions 139 is positioned between the chuck pins 11, 15 with the slider holding portion 8 being spaced away from the fixing holding portion 7. Further, the slider 12 is fixed to the holding portion 4 with the slider holding portion 8 being close to the fixing holding portion 7, the tip ends of the chuck pins 11, 15 being inserted into an end portion of the developing sleeve 132, and the developing sleeve 132 being sandwiched between the chuck pins 11, 15. The fixing holding portion 254 causes the one end portion 259*a* of the containing tank 259 to be contained in the cylindrical holding member 265 and thus supports the one end portion 259*a* of the containing tank 259. Thereby, the holding portion 4 sandwiches the developing sleeve 132 between the chuck pins 11, 15 and holds the developing sleeve 132.

The motor 2 is attached to the upper end portion of the slider support 13 of the slider holding portion 8. The motor 2 is driven to rotate the rotating chuck 14 around the axis of rotation of the motor 2. The motor 2 causes the developing sleeve 132 sandwiched between the chuck pins 11, 15 to rotate around the axis of rotation of the motor 2.

The tool moving portion 5 includes a linear guide 16 and an actuator for moving (not shown). The linear guide 16 includes a rail 17 and a slider 18. The rail 17 is installed on the base 3. The rail 17 is formed to a straight line shape. The longitudinal direction of the rail 17 is disposed parallel to the longitudinal direction of the base 3 or the axis of rotation of the developing sleeve 132 sandwiched between the chuck pins 11, 15. The slider 18 is movably supported along the longitudinal direction of the rail 17.

The actuator for moving is attached to the base 3 and slidably moves the slider 18 described above along the longitudinal direction of the base 3 or the longitudinal axis of the developing sleeve 132 sandwiched between the chuck pins 11, 15.

The tool 6 includes a tool body 19, a motor for rotating the tool 20 as a rotating tool portion, and an end mill 21 as a rotating tool. The tool body 19 is formed to a support shape raised from the slider 18.

Figure 11B:
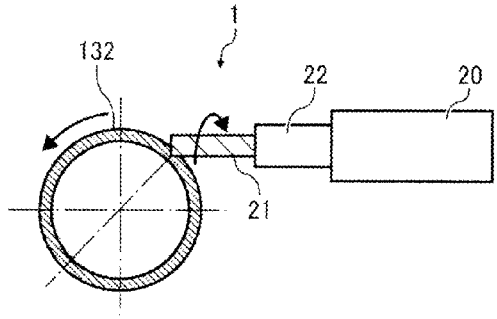
FIG. 11B is a cross sectional view taken on line VIIB-VIIB of FIG. 11A.

The motor for rotating the tool 20 is attached to the upper end portion of the tool body 19. The output shaft 22 of the motor for rotating the tool 20 is disposed with it protruding from the upper end portion of the tool body 19 to the developing sleeve 132 sandwiched between the chuck pins 11, 15, as shown in FIG. 11B. The output shaft 22 of the motor for rotating the tool 20 is disposed with it crossing (in the illustrated example, perpendicular to) the axis of rotation of the developing sleeve 132 sandwiched between the chuck pins 11, 15.

The end mill 21 is generally formed in a cylindrical shape and attached to a tip end of the output shaft 22 of the motor for rotating the tool 20. For this reason, the end mill 21 is disposed with the axis of rotation thereof being parallel to the surface of the base 3 and crossing (in the illustrated example, perpendicular to) the axis of rotation of the developing sleeve 132 sandwiched between the chuck pins 11, 15. Further, the end mill 21 is disposed with it protruding from the upper end portion 19 to the developing sleeve 132 sandwiched between the chuck pins 11, 15.

Figure 11C:
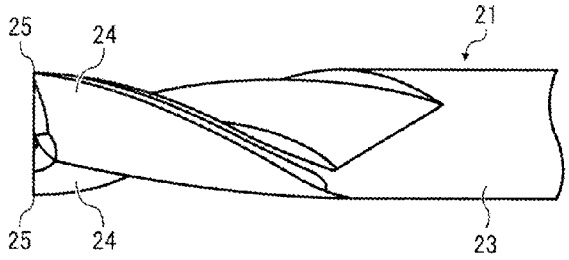
FIG. 11C is an enlarged side view illustrative of an end mill shown in FIG. 11B.
Figure 11D:
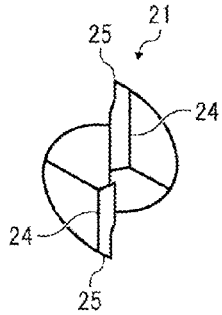
FIG. 11D is a front view illustrative of a tip end of the end mill shown in FIG. 11C.

The end mill 21 includes a circular body portion 23 and two cutting blades 24, as shown in FIG. 11C. The body portion 23 is mounted on the tool body 19. The cutting blades 24 are formed at a tip end of the body portion 23 in a spaced manner along the circumferential direction of the tip end, the tip end being close to the developing sleeve 132. The cutting blade 24 is provided with it protruding toward the peripheral direction of the body portion 23 or the end mill 21 from an outer edge of the tip end of the body portion 23 as shown in FIG. 11D.

As a result of the motor for rotating the tool 20 rotating the end mill 21 around the axis of rotation of the motor 2, the depressions 139 are formed on the external surface of the developing sleeve 132

The control device is a computer which has a well-known RAM, ROM, CPU, and so on. The control device is connected to the motor 2 as the driven rotating portion, the actuator for moving of the tool moving portion 5, the motor for rotating the tool, and so on, and controls them to control the whole surface treatment device 1.

When forming a large number of depressions 139 on the external surface of the developing sleeve 132, the control device is configured to rotate the developing sleeve 132 around the axis of rotation of the developing sleeve 132 by means of the motor 2 as the driven rotating portion, and move the tool along the axis of rotation (longitudinal direction) by means of the actuator for moving, while rotating the end mill 21 by means of the motor for rotating the tool 20 around the axis of rotation of the end mill 21. And the control device is configured to intermittently perform a cutting process on the external surface of the developing sleeve 132 by means of the cutting blades 24 accompanied by the rotation of the end mill 25 and forms the large number of depressions 139.

At this time, the curvature radius of each of the depressions 139 formed along the longitudinal direction of the developing sleeve 132 is defined based upon the curvature radius of each of the outer edges of the cutting blade 24. The depth of each of the depressions 139 is defined by the cutting amount of the cutting blade 24. The interval along the longitudinal direction of each of the depressions 139 formed on the external surface of the developing sleeve 132 based upon the moving velocity of the tool 6 is defined. Herein, assuming that, the number of the depressions 139 circumferentially formed on the external surface of the developing sleeve 132 is defined as "n", the number of rotations of the motor 2 as the driven rotating portion or the number of rotations of the developing sleeve is defined as "N1", the number of the cutting blades 24 of the end mill 21 is defined as "m", and the number of rotations of the end mill is defined as "N2", the control device controls the motor 2 as the driven rotating portion, the actuator for moving of the tool moving portion 5, and the motor for rotating the tool 20 of the tool 6 so as to fulfill the following Equation (2).

$$N2=N1\times[m/[(n/2)-0.5]] \qquad \text{Equation (2)}$$

The control device can machine the external surface of the developing sleeve 132 by suitably changing these respective requirements and optionally changing each size or density of the depressions 139.

Furthermore, connected are some kinds of input devices such as a keyboard, some kind of a display device such as "display" to the control device.

Next, the process for manufacturing the developing sleeve 132 in which the cutting process is performed on the external surface of the developing sleeve 132 by means of the surface treatment device 1 having the arrangement described above will be explained below.

A part number or the like of the developing sleeve 132 is first input from the input device into the control device.

In addition, if the operation-start commands are input from the input device, the controller drives the motor 2 as the driven rotating portion, the actuator for moving of the tool moving portion 5, and the motor for rotating the tool 20 of the tool 6. Then, the cutting blade 24 of the end mill 21 which rotates around the axis of rotation of the end mill 21 intermittently performs the cutting process on the external surface of the developing sleeve 132 and thus the depressions 139 are formed. Namely, the depressions 139 are formed by performing the cutting process on the external surface of the developing sleeve 132 by means of the rotating tool 6 which rotates around the axis of rotation of the same.

Further, since the motor 2 as the driven rotating portion, the actuator for moving of the tool moving portion 5, and the motor for rotating the tool 20 of the tool 6 are simultaneously driven, when the depressions 139 are formed by performing the cutting process on the external surface of the developing sleeve 132 with the rotating tool 6 which rotates around the axis of rotation of the rotating tool 6, while the developing sleeve 132 arranged in a state crossing (in the illustrated example, perpendicular to) the end mill 21, the end mill 21 and the developing sleeve 132 are relatively moved in the longitudinal direction of the developing sleeve 132 and thus the depressions 139 are formed.

If the end mill 21 is positioned at a position where the cutting process of the developing sleeve 132 is completed or the other end portion of the developing sleeve 132 and the cutting process on the external surface of the developing sleeve 132 is completed, the controller stops the motor 2 as the driven rotating portion, the actuator for moving of the tool moving portion 5, and the motor for rotating the tool 20 of the tool 6

According to this embodiment, convex portions between the depressions 139 are flat external surfaces of the developing sleeve 132 prior to being subjected to the cutting process.

There are no sharp-pointed convex portions on the external surface formed by such as the conventional sand blast process and thus each of the depressions 139 is formed to a more larger depression. The depressions 139 are also not likely to be worn away by a change over time. Accordingly, it is possible to suppress a decrease of the amount for conveying the developer 126 due to a change over time.

The roundness or the coaxiality of the developing sleeve 132 prior to forming the depressions 139 thereon is low. If the distance between the end mill 21 and the external surface of the developing sleeve 132 varies when forming the depressions 139, the dimensional variation of each of the depressions 139 occurs, since the two depressions among the depressions 139, which are adjacent with each other along the longitudinal direction of the developing sleeve 132, are arranged in an end-to-end overlapping relation in a regular manner, the (typically two) depressions among the depressions 139, which are adjacent with each other in the longitudinal direction of the developing sleeve 132, continue to be arranged in an end-to-end overlapping relation. Thus, the ratio between the area in which the depressions 139 are not formed along the circumferential direction of the developing sleeve 132 and another area in which the depressions 139 are formed is difficult to vary. For this reason, since the developer 126 is uniformly absorbed on the external surface of the developing sleeve 132, it is possible to prevent the variation in density from occurring. Therefore, it is possible to prevent the variation in density from occurring without using high precision material. Further, in order to maintain the high quality image in the future high speed machine, it is possible to correspond to the increase of the absorbed amount of the developer.

Further, since the depressions 139 are regularly arranged, it is easy to set up the process condition in which the optimum absorbing amount of the developer 126 is ensured while the longevity is intended and it is possible to reliably form the depressions 139 under the setting condition, which leads to achieving the excellent advantageous merits in machining process characteristics.

Further, since a large number of depressions 139 each having an elongated shape extending in the longitudinal direction are regularly formed on the external surface of the developing sleeve 132 and the total volume of these depressions 139 is adapted to be not less than 0.5 $mm^3$ per a region of 100 $mm^2$ of the external surface of the developing sleeve 132, the sufficient conveying force of the developer 126 can be obtained.

Further, since it is possible to prevent the image variation caused by the conveying force variation by regularly arranging the depressions 139 in an equivalently shaped and sized manner, and the total volume of these depressions 139 is adapted to be not less than 0.5 $mm^2$ per an area of 100 $mm^2$ of the external surface of the developing sleeve 132, it is possible for a plurality of depressions 139 to be always in the development area 131, thereby preventing the image variation due to the slippage of the developer 126.

Since the longitudinal direction of each of the depressions 139 is disposed parallel to the longitudinal direction of the developing sleeve 132, the developer 126 to be absorbed is juxtaposed along the longitudinal direction of the developing sleeve 132. For this reason, if the developing sleeve 132 is rotated, the absorbed developer 126 is difficult to fall away from the external surface of the developing sleeve 132. Therefore, since the depressions 139 each have an oval shape, similar advantageous merits to those of the grooves that have been conventionally used can be achieved, thereby ensuring the absorbing amount of the developer 126.

Since a cross section of each of the depressions 139 in the longitudinal direction of the developing sleeve 132 is formed to a circular arc shape, it is possible to increase the amount of developer 126 capable of being contained in the depressions 139, thereby enabling the sufficient amount of developer 126 to convey.

Since two depressions among the depressions 139, which are adjacent with each other, are offset in the longitudinal direction of the developing sleeve 132, it is possible to prevent the area in which the depressions 139 are not formed on the external surface of the developing sleeve 132 or another area in which a large number of depressions 139 are formed thereon from occurring. Thus, it is possible to prevent the variation from occurring in the developer 126 absorbed on the external surface of the developing sleeve 132, that is to say, it is possible to uniformly absorb the developer 126 on the external surface of the developing sleeve 132. Thus, it is possible to prevent the variation in image from occurring.

Since the depressions 139 are formed on the external surface of the developing sleeve 132 in a spiral manner, it is possible to prevent the variation from occurring in the developer 126 absorbed on the external surface of the developing sleeve 132, that is to say, it is possible to uniformly absorb the developer 126 on the external surface of the developing sleeve 132. Thus, it is possible to prevent the image variation from occurring.

Since the depressions 139 are formed on the external surface of the developing sleeve 132 by means of the end mill, it is possible to reliably and regularly form the depressions 139 on the external surface of the developing surface 132. Thus, it is possible to prevent the image variation from occurring.

Since the depressions 139 are formed by rotating the developing sleeve 132 around the axis of rotation thereof and moving the end mill, it is possible to reliably and regularly form the depressions 139 on the external surface of the developing sleeve 132. Thus, it is possible to prevent the image variation from occurring.

Since each of the developing device 113, the process cartridges 106Y, 106M, 106C, 106K and the image forming device 101 comprises the development roller 115, it is possible to suppress a decrease of the amount for conveying the developer 126 due to a change over time and prevent the image variation.

Figure 12A:
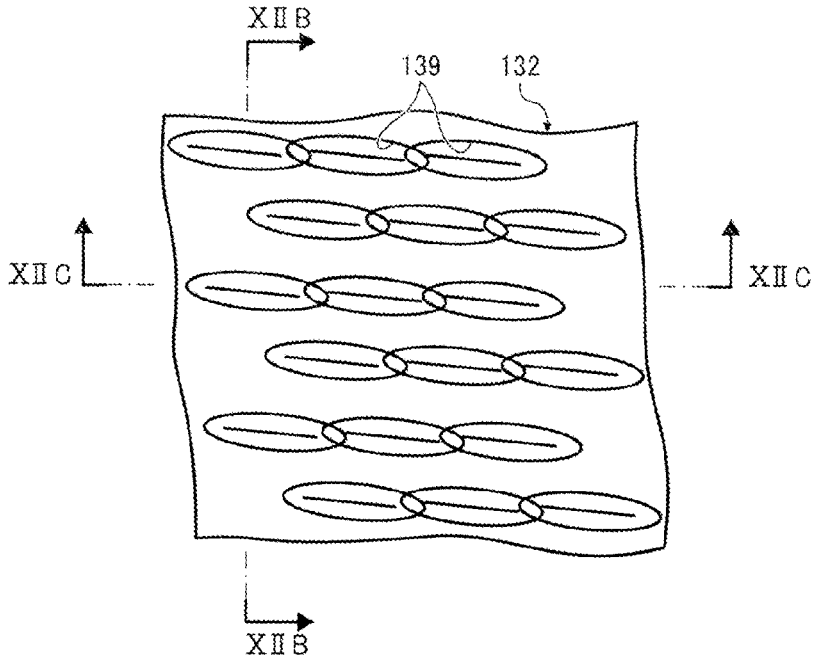
FIG. 12A is a schematic enlarged view illustrative of a portion of an external surface of the variant of the developing sleeve shown in FIG. 6A.
Figure 12B:
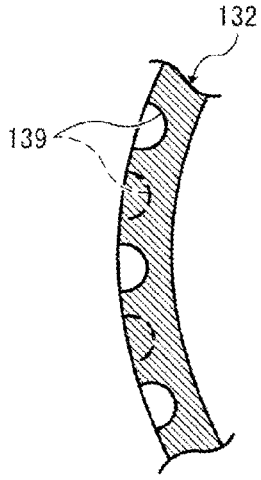
FIG. 12B is a cross sectional view taken on line XIIB-XIIB of FIG. 12A.
Figure 12C:
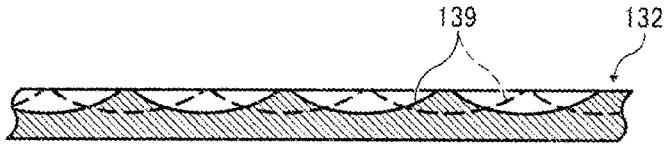
FIG. 12C is a cross sectional view taken on line XIIC-XIIC of FIG. 12A.

In the embodiment described above, a cross section of each of the depressions 139 in the circumferential direction of the developing sleeve 132 is formed to a V shape. However, according to the present invention, as shown in FIGS. 12A to 12C, a cross section of each of the depressions 139 in the circumferential direction of the developing sleeve 132 may be formed to a circular arc shape. In the illustrated embodiments, cross sections of each of the depressions 139 in the circumferential and longitudinal directions of the developing sleeve 132 are formed in a circular arc shape. In this case, as shown in FIG. 14, a cross section of each of the depressions 139 in the circumferential direction of the developing sleeve 132 is formed to a circular arc shape by forming an external edge of each cutting blades 24 of the end mill 21 to a circular arc shape. Further, although this is not always limited to this embodiment, an angle θ (shown in FIG. 13) between an inner surface of each of the depressions 139 in the cross section taken along the circumferential direction of the developing sleeve 132 and the external surface of the developing sleeve 132 is preferably not more than 60° in order to avoid the differences in the developing density caused by the effect of the developing magnetic poles described above. Meanwhile, in FIGS. 12 to 14 parts equivalent to those in the previously described embodiment are denoted by the same reference numerals.

Figure 13:
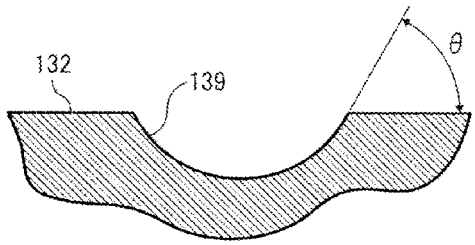
FIG. 13 is a cross sectional enlarged view illustrative of a portion of FIG. 12B.
Figure 14:
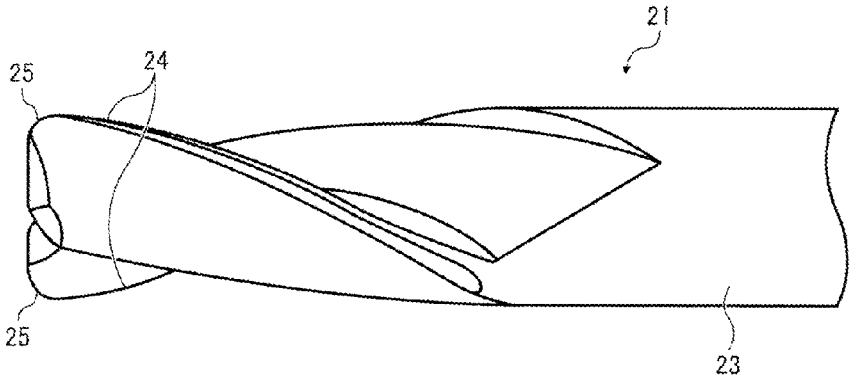
FIG. 14 is an enlarged side view illustrative of the end mill for forming the depressions on the external surface of the developing sleeve shown in FIG. 12.

According to the example shown in FIGS. 12 to 14, since the cross sections of each of the depressions 139 both in the longitudinal and circumferential directions of the developing sleeve 132 are formed to a circular arc shape, it is possible to increase the amount of developer 126 which may be contained in each of the depressions 139, thereby enabling the sufficient amount of the developer 126 to convey.

Next, a second embodiment of the present invention will be described with reference to FIGS. 15 to 19.

Parts equivalent to the first embodiment described above are denoted by the same reference numerals.

Figure 15:
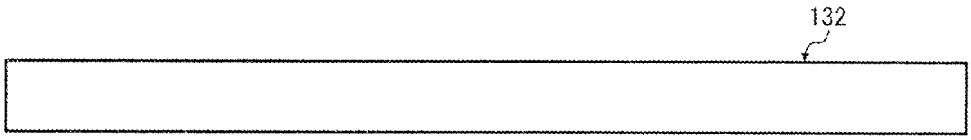
FIG. 15 is a side view illustrative of a developing sleeve according to a second embodiment of the present invention.

In the developing sleeve 132 in the embodiment of the present invention as shown in FIG. 15, similar to the above-described first embodiment, the depressions 139 formed on the external surface of the developing sleeve 132 each having an oval shape viewed from the top are formed so that the longitudinal direction thereof is formed along the longitudinal direction of the developing sleeve 132 and in a slightly curved oval shape. The depressions 139 are arranged side by side along the spiral curve on the external surface of the developing sleeve 132 as shown in dot-dash lines in FIG. 16.

Figure 16:
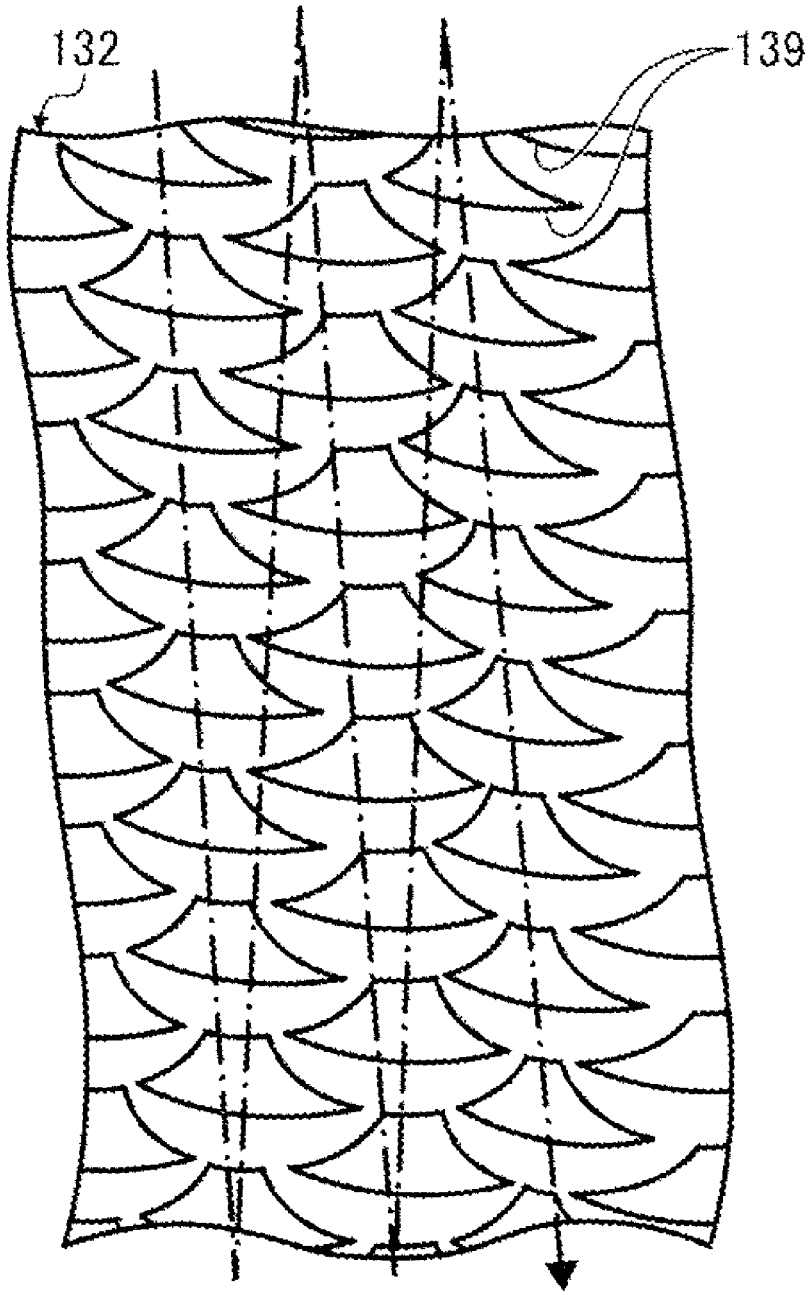
FIG. 16 is a schematic enlarged view illustrative of a portion of an external surface of the developing sleeve shown in FIG. 15.
Figure 17A:
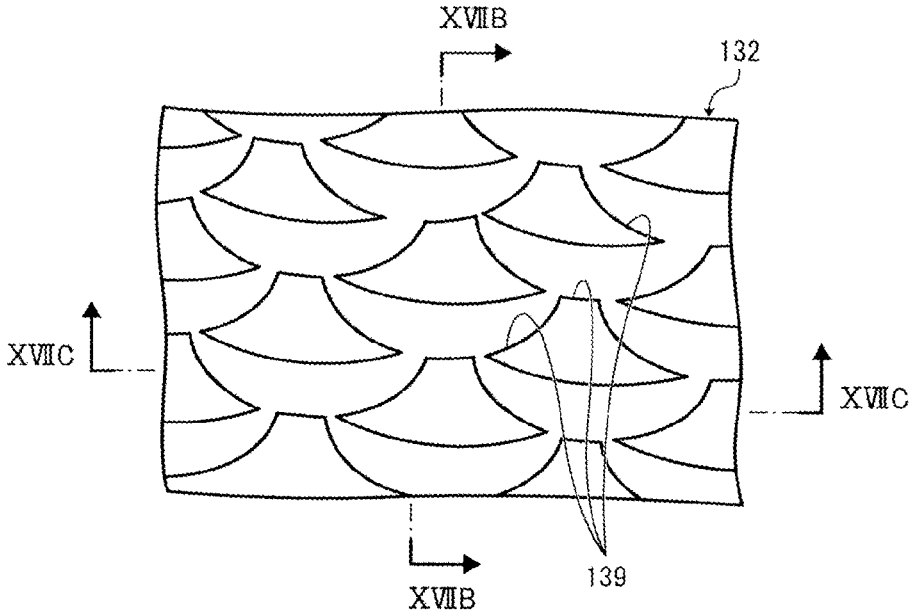
FIG. 17A is a schematic enlarged view illustrative of a portion of the external surface of the developing sleeve shown in FIG. 15.
Figure 17B:
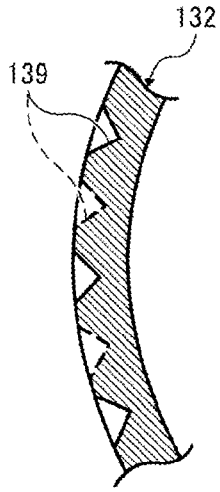
FIG. 17B is a cross sectional view taken on line XVIIB-XVIIB of FIG. 17A.
Figure 17C:
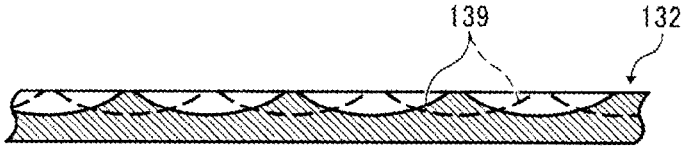
FIG. 17C is a cross sectional view taken on line XVIIC-XVIIC of FIG. 17A.

Further, as shown in FIGS. 16 and 17A, a large number (plurality) of the depressions 139 described above are arranged in a regular manner so that the ends of the two depressions which are adjacent with each other along the circumferential direction of the developing sleeve 132, among the depressions 139 are overlapped with each other. In this embodiment, the two depressions which are adjacent with each other along the circumferential direction of the developing sleeve 132 are arranged so that the ends thereof are overlapped with each other and the two depressions which are adjacent with each other along the longitudinal direction of the developing sleeve 132 are arranged so that the ends thereof are spaced with each other. As such, the external surface of the developing sleeve 132 is formed with isolated convex portions arranged in a regular manner by means of the ends of the two depressions which are adjacent with each other along the circumferential direction of the developing sleeve 132, among the depressions 139, and with other isolated convex portions arranged in a irregular manner by means of the ends of the two depressions which are adjacent with each other along the longitudinal direction of the developing sleeve 132, among the depressions 139.

Further, the overlapping ratio in the widthwise direction of the depressions 139 of which both ends are overlapped with each other along the circumferential direction of the developing sleeve 132 is defined as shown in the Equation (3) as follows.

$$(PO-P)/P\times 100\% \qquad \text{Equation (3)}$$

Herein, PO denotes a widthwise length of each of the depressions 139 along the circumferential direction of the developing sleeve 132 as shown in FIG. 18. P denotes an interval between the two depressions 139 which are adjacent with each other among the depressions 139 along the circumferential direction of the developing sleeve 132 as shown in FIG. 18. These PO and P denote sizes formed on the external surface of the developing sleeve 132 if the developing sleeve 132 is formed to a complete cylindrical shape and the completed cylindrical developing sleeve 132 has an ideal shape without manufacturing errors. As an example, each of FIGS. 18B and 18C shows a top plan view of a part of the developing sleeve 132 in the case where the overlapping ratio along the circumferential direction as described above is 0%. Each of FIGS. 18B and 18C shows a top plan view of a part of the developing sleeve 132 in the case where the overlapping ratio along the circumferential direction as described above is larger than 0%.

Figure 19:
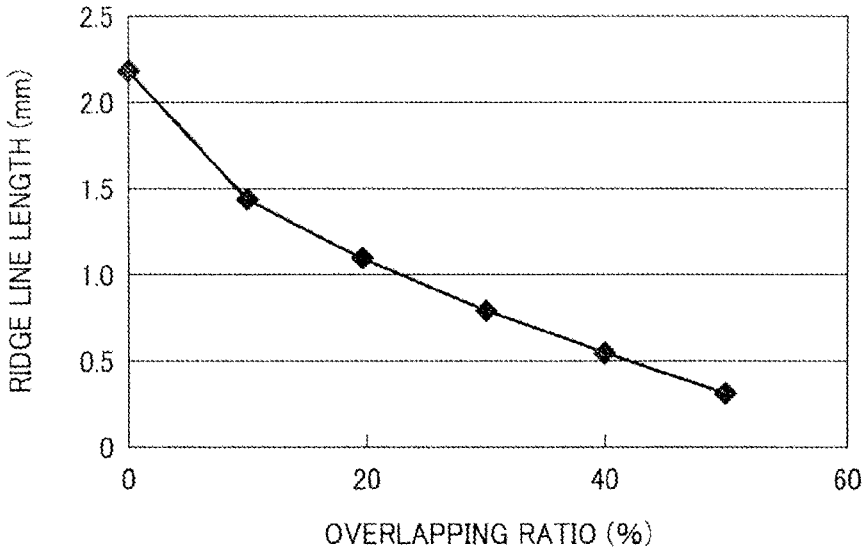
FIG. 19 is a graph illustrative of the variation in the ridge line length versus the variation in the overlapping ratio of the depressions which are adjacent with each other shown in FIG. 18A.

Further, FIG. 19 shows a variation of the ridge line described above when the overlapping ratio along the circumferential direction described above is varied. According to FIG. 19, if the overlapping ratio becomes larger, the length of the ridge line becomes shorter. Because the overlapping ratio becomes larger, the conveying performance of the developer 126 is lowered and thus the interval between the two depressions 139 which are adjacent with each other along the circumferential direction is shortened. For this reason, since the time required for processing the depressions 139 will be lengthened, the overlapping ratio along the circumferential direction will be preferred to be substantially smaller and thus it is obvious that the overlapping ratio of 2 to 10% will be desirable.

Figure 20:
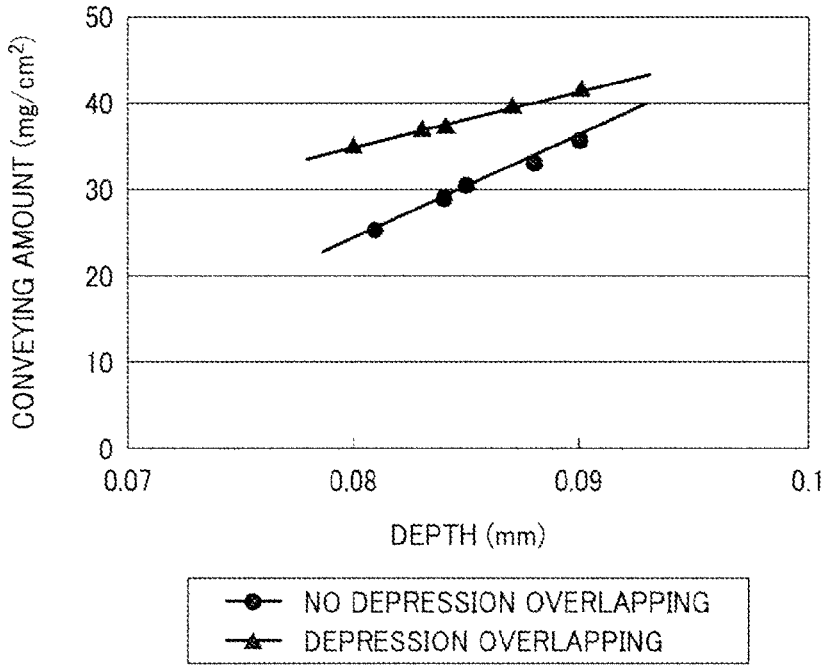
FIG. 20 is a graph illustrative of the variation in the conveying amount of the developer versus the variation in depth of the depressions which are adjacent with each other shown in FIG. 18A.

Further, FIG. 20 shows the variation in the conveying amount of the developer 126 versus the variation in depth of each of the depressions 139 between the case where the ends of the two depressions 139 which are adjacent with each other along the circumferential direction of the developing sleeve 132 are overlapped with each other and the case where the ends of the two depressions 139 which are adjacent with each other along the circumferential direction of the developing sleeve 132 are spaced with each other. According to FIG. 20, it is confirmed that there is little effect upon the amount of conveying of the developer 126 versus the offset in the depth of each of the depressions 139 in the case where the depressions 139 are overlapped than in the case where the depressions 139 are spaced.

Figure 18A:
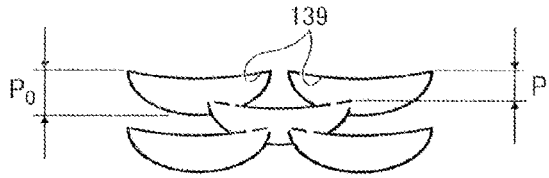
FIG. 18A is a schematic cross sectional view illustrative of the relationship of the depressions which are adjacent with each other formed on an external surface of the developing sleeve shown in FIG. 17A.
Figure 18B:
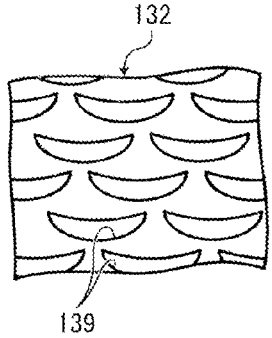
FIG. 18B is a view illustrative of a state in which the depressions which are adjacent with each other shown in FIG. 18A are not overlapped with each other.
Figure 18C:
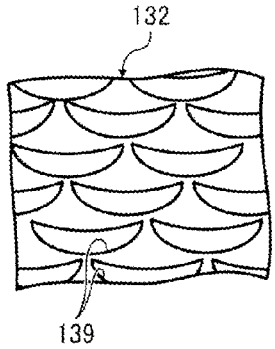
FIG. 18C is a view illustrative of a state in which the depressions which are adjacent with each other in a more close manner than that of FIG. 18B are not overlapped with each other.
Figure 18D:
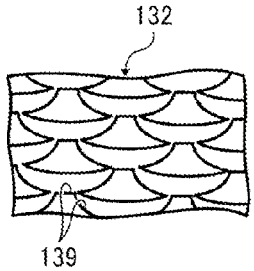
FIG. 18D is a view illustrative of a state in which the depressions which are adjacent with each other shown in FIG. 18A are overlapped with each other.
Figure 18E:
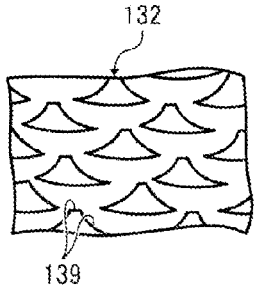
FIG. 18E is a view illustrative of a state in which the depressions which are adjacent with each other in a more close manner than that of FIG. 18D are overlapped with each other.

Thus, in the case where the depressions 139 are not overlapped as shown in FIGS. 18B and 18C, the deeper the depressions 139 become, the larger the volume of each of the depressions increases and the longer the ridge line of each of the depressions becomes, whereby the variation in the conveying amount of the developer 126 is large due to the offset in depth of each of the depressions 139. In the case where the depressions 139 are overlapped as shown in FIGS. 18D and 18E, the deeper the volume of each of the depressions 139 increases but the shorter the ridge line of each of the depressions becomes, since the increase of the volume and the shortage of the ridge line are offset, it is clear that the variation in the conveying amount of the developer 126 becomes small. Taking the above into account, in the present invention, it is desirable to determine the overlapping ratio along the circumferential direction from the various standpoints of view.

Further, also in this embodiment, each of the depressions 139 is formed to a V shape in its widthwise cross section (namely, along the circumferential direction of the developing sleeve 132). Meanwhile, each of the depressions 139 is formed to a circular arc curved shape in its longitudinal cross section (namely, along the longitudinal direction of the developing sleeve 132).

According to this embodiment, similar to the first embodiment described above, since the convex portions between the depressions 139 are formed to a planar external surface, there are no pointed convex portions formed by such as the conventional sand blast processing. Since each of the depressions 139 is formed to a larger depression, they are also not likely to be worn away by a change over time. Thus, it is possible to suppress the decline of the variation in the conveying amount of the developer 126 due to the change over time.

Further, in the developing sleeve 132, since the roundness and coaxiality of the developing sleeve 132 prior to processing is low in precision, the distance between the end mill 21 and the external surface of the developing sleeve 132 when forming the depressions 132 varies. In the case where there is the variation in size of each of the depressions 139, since the depressions 139 are arranged in a regular manner so that the ends of two depressions which are adjacent with each other along the circumferential direction of the developing sleeve 132 are overlapped with each other, the ends of the two depressions 139 which are adjacent with each other continue to be overlapped with each other. Thus, the ratio between the area in which the depressions 139 are not formed along the circumferential direction of the developing sleeve 132 and another area in which the depressions 139 are formed is difficult to vary. For this reason, since the developer 126 is uniformly absorbed on the external surface of the developing sleeve 132, it is possible to prevent the variation in density from occurring. Therefore, it is possible to prevent the variation in density from occurring without using high precision material. Further, in order to maintain the high quality image in the future high speed machine, it is possible to correspond to the increase of the absorbed amount of the developer.

Figure 21A:
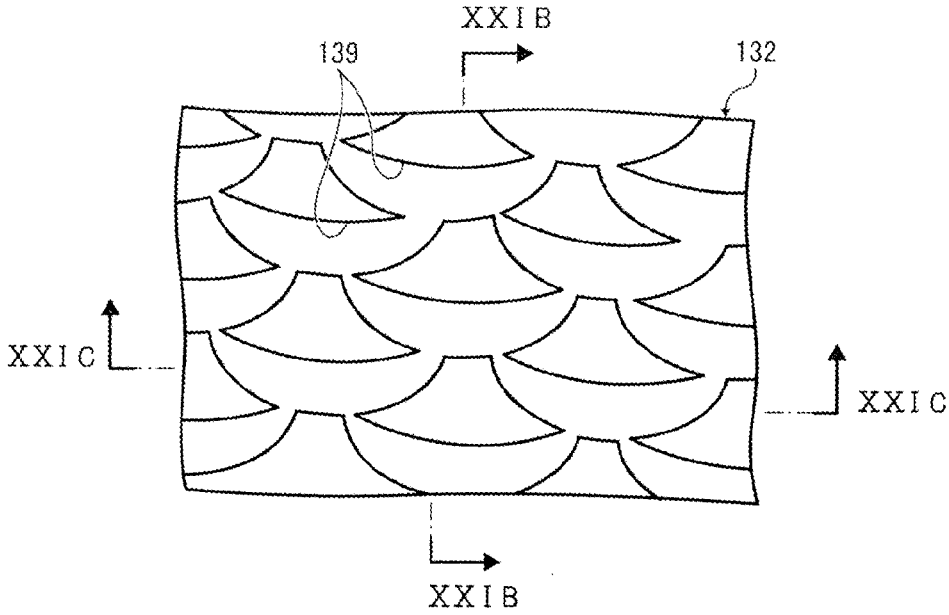
FIG. 21A is a schematic enlarged view illustrative of a portion of an external surface of the variant of the developing sleeve shown in FIG. 17.
Figure 21B:
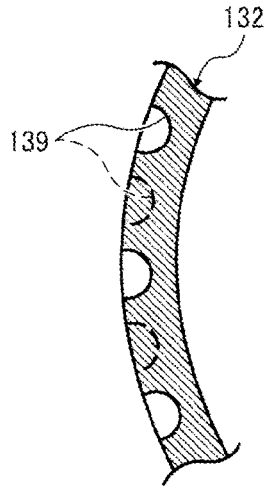
FIG. 21B is a cross sectional view taken on line XXIB-XXIB of FIG. 21A.
Figure 21C:
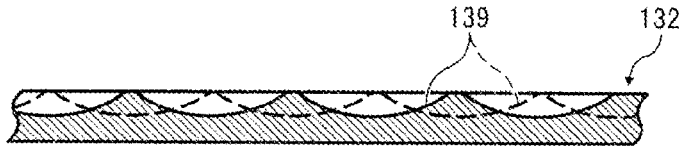
FIG. 21C is a cross sectional view taken on line XXIC-XXIC of FIG. 21A.

Further, also in this embodiment, similar to the first embodiment described above, as shown in FIGS. 21A to 21C, the cross section of each of the depressions 139 along the longitudinal direction of the developing sleeve 132 may be formed to a circular arc shape. In the illustrated embodiments, the cross sections of each of the depressions 139 along the circumferential and longitudinal directions of the developing sleeve 132 are formed to a circular arc shape. According to the embodiment shown in FIG. 21, since the cross sections of each of the depressions 139 along the circumferential and longitudinal directions of the developing sleeve 132 are formed to a circular arc shape, it is possible to increase the amount of developer 126 which may be contained in each of the depressions 139, thereby enabling the sufficient amount of the developer 126 to convey.

Figure 22:
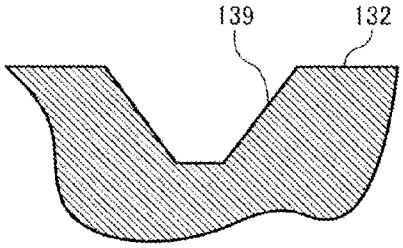
FIG. 22 is a cross sectional view illustrative of the variant of one of the depressions formed on an external surface of the developing sleeve of the present invention.
Figure 23:
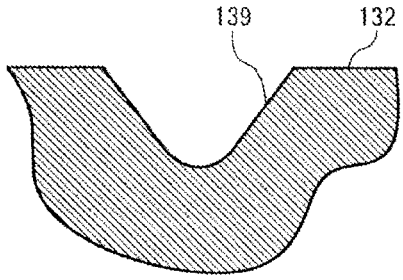
FIG. 23 is a cross sectional view illustrative of the another variant of one of the depressions formed on the external surface of the developing sleeve of the present invention.

Further, in the first and second embodiments described above, although the cross section of each of the depressions 139 along the circumferential direction of the developing sleeve 132 is formed to a V shape, in the present invention, as shown in FIGS. 22 and 23, the cross sectional shape of each of the depressions 139 along the circumferential direction may be suitably changed by appropriately changing the shape of the external edge 25 of each of the cutting blades 24. FIG. 22 shows the case in which each bottom shape of the depressions 139 each having the V-shaped cross section is flattened. FIG. 23 shows the case in which each bottom shape of the depressions 139 each having the V-shaped cross section is circular-arc shaped. Parts equivalent to the embodiment described above are denoted by the same reference numerals.

Figure 24:
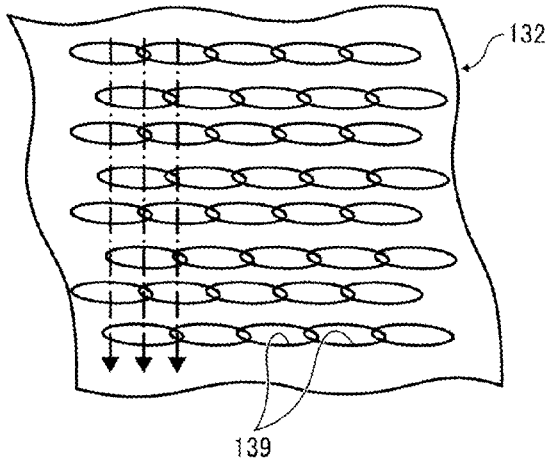
FIG. 24 is a schematic view illustrative for developing an external surface of the variant of the developing sleeve of the present invention.
Figure 25:
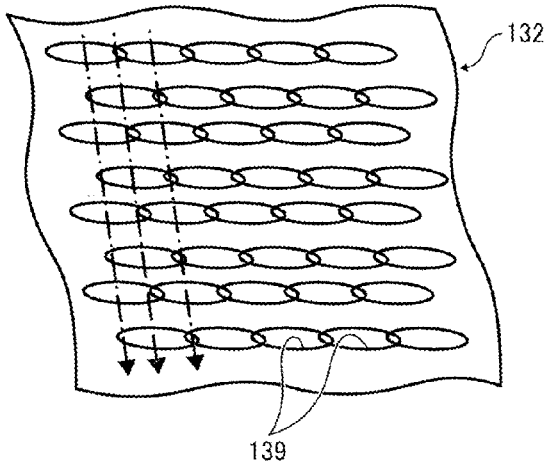
FIG. 25 is a schematic view illustrative for developing the external surface of the another variant of the developing sleeve of the present invention.

Further, in the embodiment described above, the motor 2, 20 or the actuator is (are) simultaneously and continuously operated, the depressions 139 are arranged in a spiral manner on the external surface of the developing sleeve 132, each of the depressions 139 is formed in a slightly and arcuately curved manner, and the depressions 139 may be formed along the longitudinal direction of the developing sleeve 132 in a straight line manner and a plurality of the depressions 139 may be disposed along the circumferential direction of the developing sleeve 132 in a straight line manner by appropriately and intermittently operating the motors 2, 20 or the actuator, as shown in FIGS. 24 and 25.

Figure 26A:
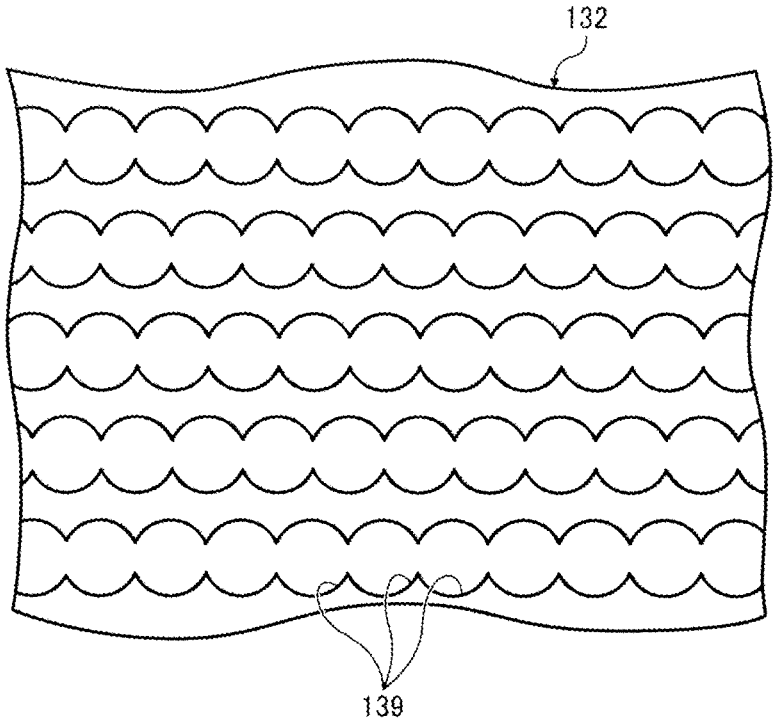
FIG. 26A is a schematic view illustrative for developing the external surface of the further variant of the developing sleeve of the present invention.
Figure 26B:
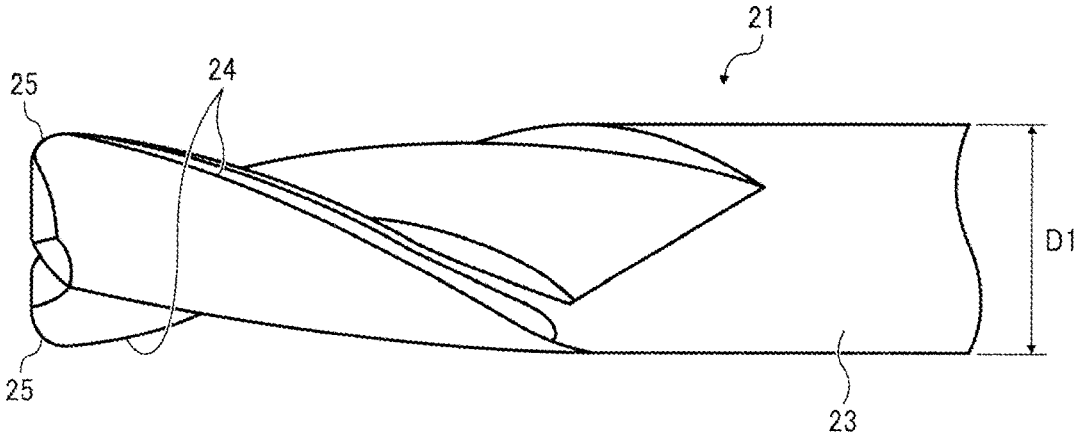
FIG. 26B is an enlarged side view illustrative of the end mill for forming the depressions shown in FIG. 26A.

Further, in the above-mentioned embodiment, although each of the depressions 139 is formed to an oval shape, in the present invention, each of the depressions 139 may be formed to a circular shape viewed from the top as shown in FIG. 26A by means of the end mill 21 of which the external diameter D1 is smaller than that in the above-mentioned embodiment. Meanwhile, although FIG. 26A shows the case where the ends of two depressions 139 which are adjacent with each other along the longitudinal direction of the developing sleeve 132 are overlapped with each other, of course, the ends of two depressions 139 which are adjacent with each other along the circumferential direction of the developing sleeve 132 may be overlapped with each other.

Further, in the above-mentioned embodiment, the two depressions 139 which are adjacent with each other along the circumferential direction of the developing sleeve 132 are arranged with the two depressions 139 being offset with each other by the degree of about a half length of each of the depressions 139. However, in the present invention, the two depressions 139 which are adjacent with each other along the circumferential direction of the developing sleeve 132 may be arranged with the two depressions 139 being offset with each other by the arbitrary length of ⅓, ¼ and so on of a half length of each of the depressions 139.

Further, in the above-mentioned embodiment, although the end mill 21 and the developing sleeve 132 are relatively moved by moving the end mill 21 along the longitudinal direction of the developing sleeve 132, in the present invention, at least one of the end mill 21 and the developing sleeve 132 may be moved along the longitudinal direction of the developing sleeve 132 or both of the end mill 21 and the developing sleeve 132 may be relatively moved.

Figure 27A:
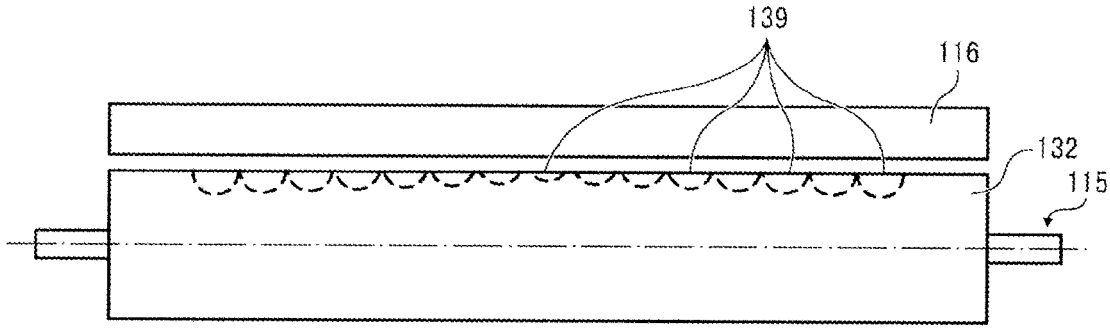
FIG. 27A is a schematic view illustrative for developing an cross section of an external surface of the variant of the developing sleeve of the present invention in which each depth of the depressions formed on the external surface gradually increases from a center of the developing sleeve to both ends thereof.
Figure 27B:
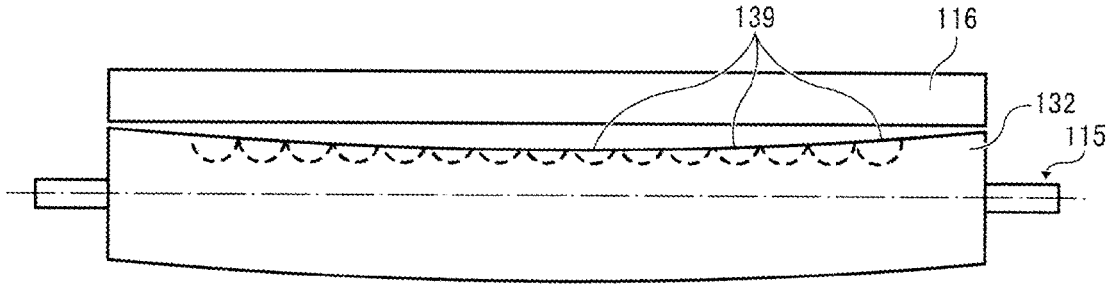
FIG. 27B is a schematic view illustrative of a state in which the developing sleeve is flexed.

Further, in the above-mentioned embodiment, although the depressions 139 each having the same shape are formed on the external surface of the developing sleeve 132, in the present invention, as shown in FIG. 27A, the depressions 139 may be formed in a gradually increasing manner from a center of the developing sleeve 132 along the longitudinal direction thereof toward both ends of the developing sleeve 132. With this arrangement, each volume of the depressions 139 may be formed in a gradually increasing manner from a center of the developing sleeve 132 along the longitudinal direction thereof to both ends thereof in the same direction. As shown in FIG. 27B, even if a doctor gap or a control gap provided in the center portion of the developing sleeve 132 along the longitudinal direction of the sleeve 132 is widened in a state that causes flexure in the development roller 115 by means of the frictional resistance force or magnetic attracting or absorbing force generated when the developing sleeve 126 passes through the doctor gap, it is possible to make the conveying amount of the developer 126 along the longitudinal direction of the developing sleeve 132 uniform, and for this reason it is possible to prevent the variation in image density from occurring.

Figure 28:
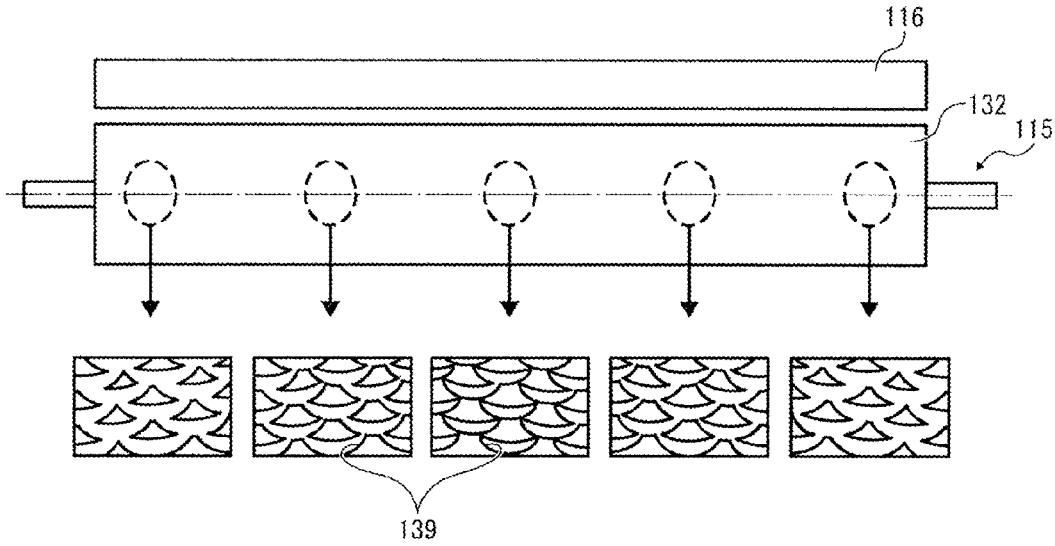
FIG. 28 is a schematic view illustrative for developing the cross section of an external surface of the variant of the developing sleeve of the present invention in which each size viewed from a top of the depressions formed on the external surface gradually increases from the center of the developing sleeve to both ends thereof.

Further, in the present invention, as shown in FIG. 28, a large number of the depressions 139 may be formed in such a manner that each area viewed from the top of the depressions 139 gradually increases from the center of the developing sleeve 132 along the longitudinal direction thereof toward both ends of the same and each interval of the two depressions 139 of the developing sleeve 132 gradually decreases toward both ends of the developing sleeve 132. With this arrangement, since each volume of the depressions 139 gradually increases from the center of the developing sleeve 132 along the longitudinal direction thereof toward both ends of the same, it is possible to make the conveying amount of the developer 126 along the longitudinal direction of the developing sleeve 132 uniform, and for this reason it is possible to prevent the variation in image density from occurring.

Figure 29:
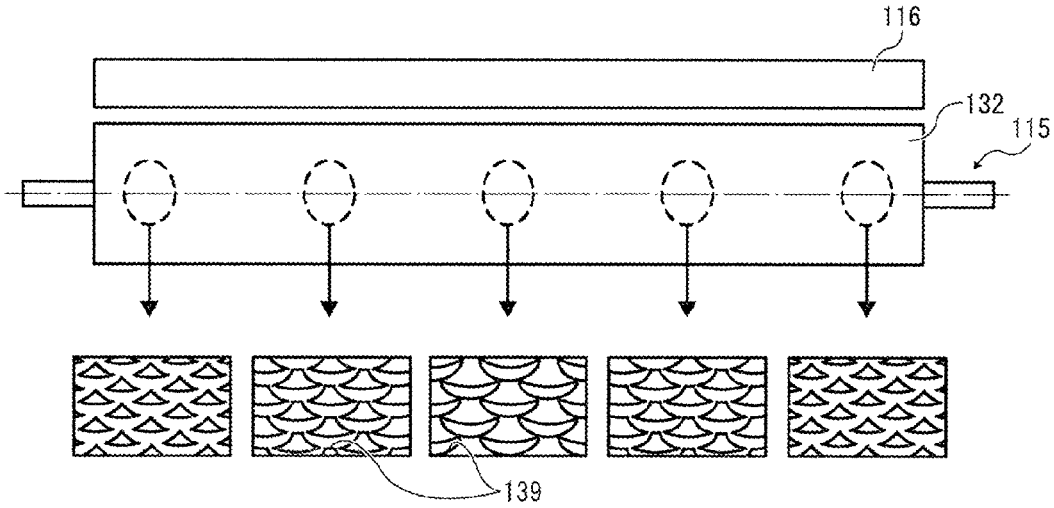
FIG. 29 is a schematic view illustrative for developing the cross section of an external surface of the variant of the developing sleeve of the present invention in which the depressions are formed so that the number of the depressions per a unit area increases from the center of the developing sleeve to both ends thereof.

Further, in the present invention, as shown in FIG. 29, a large number of the depressions 139 may be formed in such a manner that the number of the depressions 139 per unit area becomes larger from the center of the developing sleeve 132 along the longitudinal direction thereof toward both ends of the same, that is to say, the interval of the two depressions 139 gradually becomes narrower (namely, in an irregular manner) toward both ends of the developing sleeve 132 with each other. With this arrangement, since each volume of the depressions 139 gradually increases from the center of the developing sleeve 132 along the longitudinal direction thereof toward both ends of the same, it is possible to make the conveying amount of the developer 126 along the longitudinal direction of the developing sleeve 132 uniform and for this reason it is possible to prevent the variation in image density from occurring. In FIGS. 27 to 29, parts equivalent to the embodiment described above are denoted by the same reference numerals. Meanwhile, as long as not contrary to the purpose of the present invention, the depth of the depressions 139, any combination of the area viewed from the top, and the number of the depressions 139 per unit area may be appropriately combined. Further, although FIGS. 28 and 29 each shows the case where the ends of the two depressions 139 which are adjacent with each other along the circumferential direction of the developing sleeve 132 are overlapped with each other, of course, in the present invention, the ends of the two depressions 139 which are adjacent with each other along the longitudinal direction of the developing sleeve 132 may be overlapped with each other.

In the above-mentioned image forming apparatus 101, each of the process cartridges 106Y, 106M, 106C, and 106K includes the cartridge case 111, the charged roller 109, the photo conductive drum 108, the cleaning blade 112 and the development device 113. However, according to the present invention, although each of the process cartridges 106Y, 106M, 106C, and 106K may include at least the development device 113, they may not include the cartridge case 111, the charged roller 109, the photo conductive drum 108, and the cleaning blade 112. Moreover, in the above-mentioned embodiments, the image forming apparatus 101 is configured to include the process cartridges 106Y, 106M, 106C and 106K detachably attached to the main body 102. However, although the image forming apparatus 101 may include the development device 113, it may not include the process cartridges 106Y, 106M, 106C and 106K.

Next, the inventors of the present invention manufactured various kinds of the developing sleeve 132 of the first embodiment described above and tested the advantageous merits of these developing sleeves 132.

As a result, the following Table 1 was obtained,

TABLE 1

| | Image degradation due to a change over time | The variation in light and shade |
|---|---|---|
| According to the present invention 1 | ○(Good) | ○(Good) |
| According to the present invention 2 | ○(Good) | ○(Good) |
| According to the present invention 3 | ○(Good) | ○(Good) |
| According to the present invention 4 | ○(Good) | ○(Good) |
| Comparative Example 1 | ○(Good) | x(Poor) |
| Comparative Example 2 | x(Poor) | ○(Good) |
| Comparative Example 3 | Δ(Neutral) | ○(Good) |

In the experiment of which the result is shown in Table 1, the variation in density of each of the images formed by means of the image forming device 101 and the deterioration in density of each of the images after feeding three hundred thousand sheets by using the development roller 115 having the developing sleeve 132 as shown in According to the present invention 1 to 4 and Comparative Examples 1 to 3 were estimated.

According to the present invention 1, the depressions 139 are formed on the external surface of the developing sleeve 132 composed of aluminum alloy having an external diameter of 18 mm, by driving the surface treatment device 1, under a condition that the end mill 21 having an external diameter of 2 mm is used, wherein the rotating number of the developing sleeve 132 is 400 rpm, the rotating number of the end mill 21 is 25500 rpm, and the moving speed of the end mill 21 along the longitudinal direction of the developing sleeve 132 is 0.35 mm/rev.

The depressions 139 are formed on the external surface of the developing sleeve 132 in a spiral manner so that a cross section of each of the depressions 139 is formed to a circular shape of which the curvature radius is 0.1 mm, the cross section of the developing sleeve 132 along the longitudinal direction thereof is formed to a circular shape of which curvature radius is 1.0 mm, the interval between the two depressions 139 along the circumferential direction of the developing sleeve 132 is 0.22 mm, the interval between the two depressions 139 along the longitudinal direction of the developing sleeve 132 is 0.7 mm, and the ends of the two depressions 139 which are adjacent with each other along the longitudinal direction of the developing sleeve are overlapped with each other. The magnet roller 133 is housed into the thus obtained developing sleeve 132 so as to manufacture the development roller 115, thereby forming images by means of the image forming device 101 by employing the development roller 115.

According to the present invention 2, the depressions 139 are formed on the external surface of the developing sleeve 132 composed of aluminum alloy having an external diameter of 18 mm, by driving the surface treatment device 1, under a condition that the end mill 21 having an external diameter of 2 mm is used, wherein the rotating number of the developing sleeve 132 is 400 rpm, the rotating number of the end mill 21 is 25500 rpm, and the moving speed of the end mill 21 along the longitudinal direction of the developing sleeve 132 is 0.3 mm/rev.

The depressions 139 are formed on the external surface of the developing sleeve 132 in a spiral manner so that the cross section of each of the depressions 139 is formed to a circular shape of which the curvature radius is 0.1 mm, the cross section of the developing sleeve 132 along the longitudinal direction thereof is formed to a circular shape of which curvature radius is 1.0 mm, the interval between the two depressions 139 along the circumferential direction of the developing sleeve 132 is 0.22 mm, the interval between the two depressions 139 along the longitudinal direction of the developing sleeve 132 is 0.6 mm, and the ends of the two depressions 139 which are adjacent with each other along the longitudinal direction of the developing sleeve are overlapped with each other. The magnet roller 133 is housed into the thus obtained developing sleeve 132 so as to manufacture the development roller 115, thereby forming images by means of the image forming device 101 by employing the development roller 115.

According to the present invention 3, the depressions 139 are formed on the external surface of the developing sleeve 132 composed of aluminum alloy having an external diameter of 18 mm, by driving the surface treatment device 1, under a condition that the end mill 21 having an external diameter of 2 mm is used, wherein the rotating number of the developing sleeve 132 is 400 rpm, the rotating number of the end mill 21 is 25500 rpm, and the moving speed of the end mill 21 along the longitudinal direction of the developing sleeve 132 is 0.3 mm/rev.

The depressions 139 are formed on the external surface of the developing sleeve 132 in a spiral manner so that the cross section of each of the depressions 139 is formed to a circular shape of which curvature radius is 0.1 mm, the cross section of the developing sleeve 132 along the longitudinal direction thereof is formed to a circular shape of which the curvature radius is 1.0 mm, the interval between the two depressions 139 along the circumferential direction of the developing sleeve 132 is 0.22 mm, the interval between the two depressions 139 along the longitudinal direction of the developing sleeve 132 is 0.6 mm, and the ends of the two depressions 139 which are adjacent with each other along the longitudinal direction of the developing sleeve are overlapped with each other. The magnet roller 133 is housed into the thus obtained developing sleeve 132 so as to manufacture the development roller 115, thereby forming images by means of the image forming device 101 by employing the development roller 115.

According to the present invention 4, the depressions 139 are formed on the external surface of the developing sleeve 132 composed of aluminum alloy having an external diameter of 18 mm, by driving the surface treatment device 1, under a condition that the end mill 21 having an external diameter of 2 mm is used, wherein the rotating number of the developing sleeve 132 is 400 rpm, the rotating number of the end mill 21 is 25500 rpm, and the moving speed of the end mill 21 along the longitudinal direction of the developing sleeve 132 is 0.25 mm/rev.

The depressions 139 are formed on the external surface of the developing sleeve 132 in a spiral manner so that the cross section of each of the depressions 139 is formed to a circular shape of which the curvature radius is 0.1 mm, the cross section of the developing sleeve 132 along the longitudinal direction thereof is formed to a circular shape of which curvature radius is 1.0 mm, the interval between the two depressions 139 along the circumferential direction of the developing sleeve 132 is 0.22 mm, the interval between the two depressions 139 along the longitudinal direction of the developing sleeve 132 is 0.5 mm, and the ends of the two depressions 139 which are adjacent with each other along the longitudinal direction of the developing sleeve are overlapped with each other. The magnet roller 133 is housed into the thus obtained developing sleeve 132 so as to manufacture the development roller 115, thereby forming images by means of the image forming device 101 by employing the development roller 115.

In the Comparative Example 1, the magnet roller 133 is housed in the developing sleeve 132 which is subjected to sand blast processing so that the Surface Roughness is Rz10 μm and the development roller is manufactured, thereby forming images by means of the image forming device 101 by employing the development roller 115.

In the Comparative Example 2, the magnet roller 133 is housed in the developing sleeve 132 in which 72 grooves each having the V-shaped depth are formed in an equivalent interval spaced manner around the external periphery along the circumferential direction of the developing sleeve 132, thereby forming images by means of the image forming device 101 by employing the development roller 115.

In the Comparative Example 3, the magnet roller 133 is housed in the developing sleeve 132 which is subjected to sand blast processing so that the Surface Roughness is to be Rz25 μm and the development roller is manufactured, thereby forming images by means of the image forming device 101 by employing the development roller 115.

Meanwhile, upon image forming, the developer 126 including the magnetic carrier having the average particle diameter of 35 μm, and the toner manufactured by the emulsion polymerization method and having the average particle diameter of 5 μm, wherein the toner density is adjusted to 7%, is used, and the developing bias is fixed to −550V DC.

Upon estimating images, the occurrence state of the variation in density at an interval which corresponds to the pitch of the V-shaped grooves, and the rotating pitch of the development roller 115 is estimated by outputting uniform density per one color, what is called, "solid image". The level of which variation in density is not visually confirmed is regarded as "Good (○)", and the level of which variation in density is confirmed is regarded as "Poor (x)". Density measurement is performed at six positions of the solid image by means of a spectral density apparatus and an average value of the values at these six positions is taken as the density. The density measurement is performed at an initial condition and at a condition after feeding three hundred thousand papers. If the density deterioration after feeding three hundred thousand papers is less than 7%, the conditions is regarded as "Neutral (Δ)", the density deterioration after feeding three hundred thousand papers is less than 10%, the condition is regarded as "Good (○)" and the density deterioration after feeding three hundred thousand papers is not less than 10%, the condition is regarded as "Poor (x)".

In the Comparative Example 1, the image was developed by means of the development apparatus using the development roller under the above-mentioned condition. As a result, a good image without the variation in density is obtained. However, after feeding three hundred thousand papers, the deterioration in density occurred.

In the Comparative Example 2, the image was developed by means of the development apparatus using the development roller under the above-mentioned condition. As a result, the deterioration in density occurred due to the change of the pitch of V-shaped grooves. A good image without the variation in density is obtained. Further, after feeding three hundred thousand papers, the deterioration in density did not occur but the deterioration in density did occur due to the change of the pitch of V-shaped grooves.

In the Comparative Example 1, the image was developed by means of the development apparatus using the development roller under the above-mentioned condition. As a result, a good image without the variation in density is obtained. However, after feeding three hundred thousand papers, the deterioration in density occurred.

On the contrary to the above-mentioned Comparative Examples 1 to 3, according to the present inventions 1 to 4, the image was developed by means of the development apparatus using the development roller under the above-mentioned condition. As a result, a good image without the variation in density is obtained. Further, after feeding three hundred thousand papers, the deterioration in density did not occur and thus a good image without the variation in density is obtained. Accordingly, it was made clear that there could be obtained an image with the variation in density not occurring and the change over the time being small.

Figure 30:
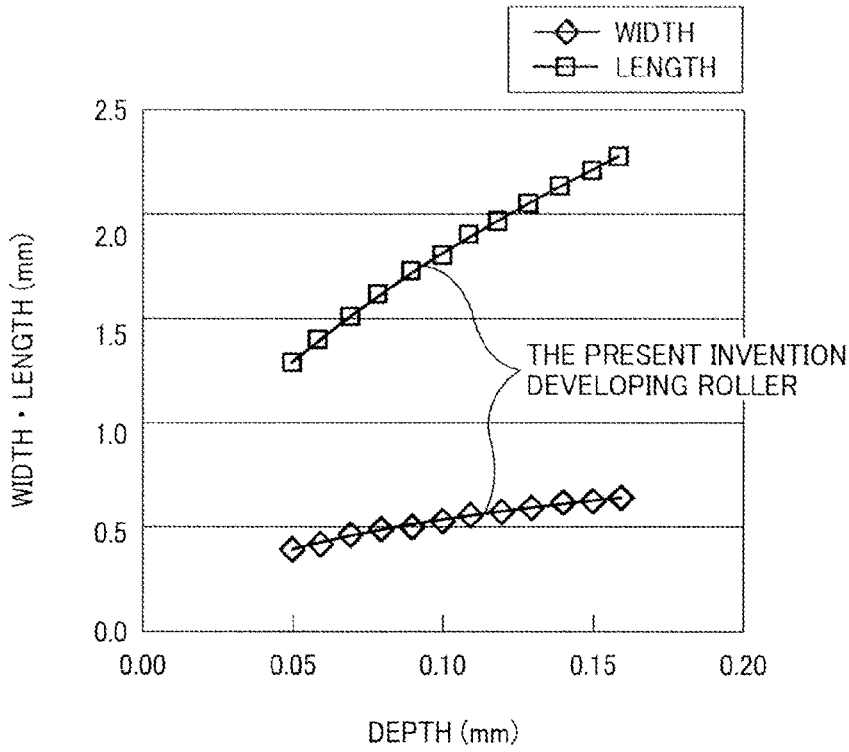
FIG. 30 is a graph illustrative of the relationship between the width and length of each of the depressions versus the depth of each of the depressions of the present invention.
Figure 31:
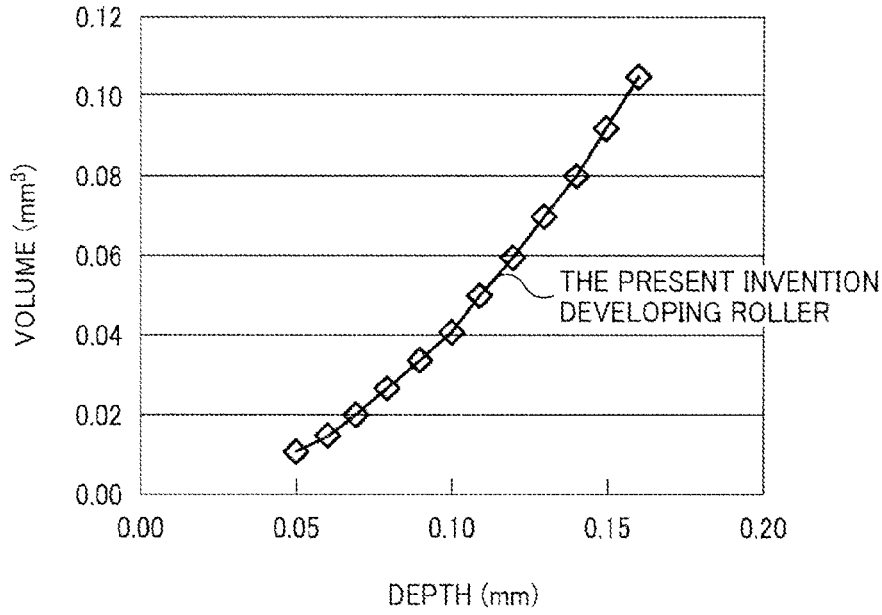
FIG. 31 is a graph illustrative of the relationship between the volume of each of the depressions versus the depth of each of the depressions of the present invention.
Figure 32:
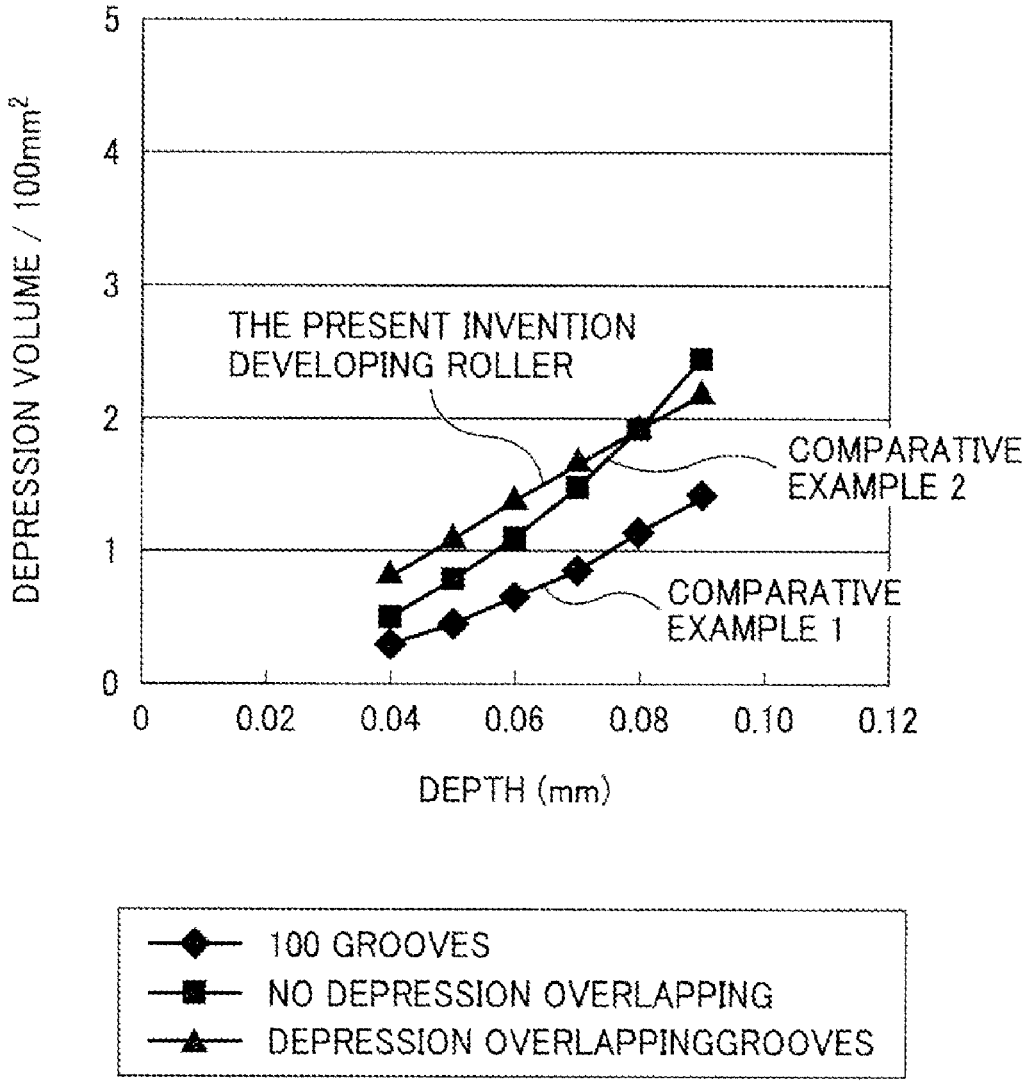
FIG. 32 is a graph illustrative of the relationship between the volume of each of the depressions per an area of 100 $mm^2$ of the present invention and the Comparative Examples 1 and 2 versus the depth of each of the depressions of the same.
Figure 33:
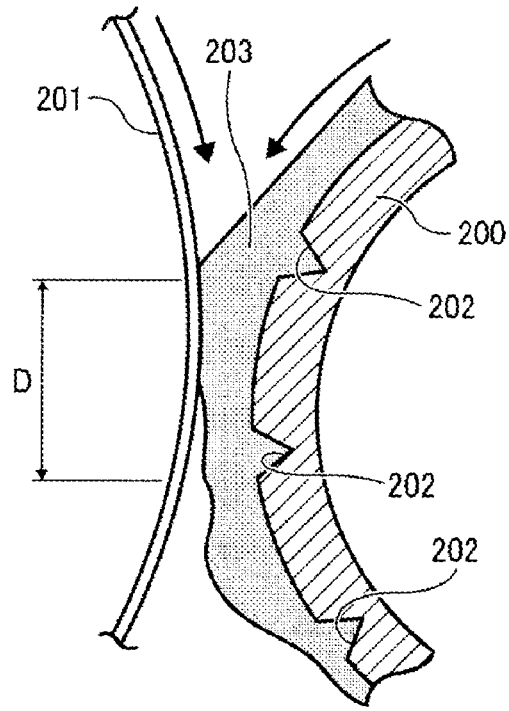
FIG. 33 is a schematic view illustrative of a state in which the prior art developing sleeve absorbs the developer.
Figure 34:
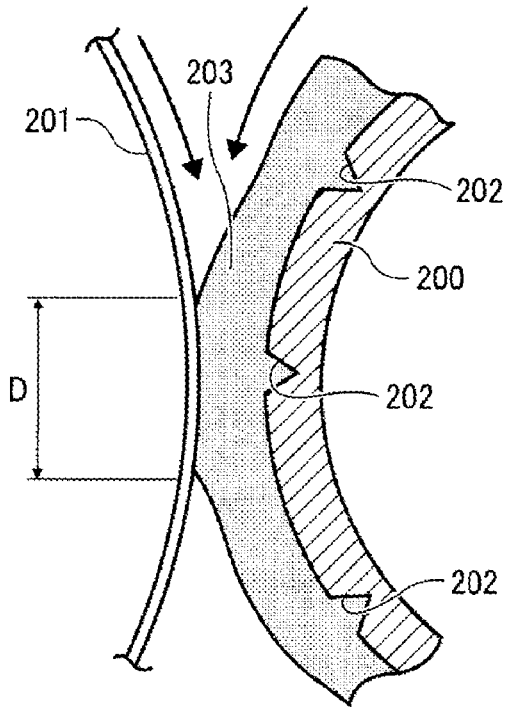
FIG. 34 is a schematic view illustrative of another state in which the developing sleeve of the present invention absorbs the developer.

Further, the inventors of the present invention manufactured the developing sleeve 132 according to the above-mentioned second embodiment of the present invention and measured the depressions 139 formed at that time. The results are shown in FIGS. 30 to 32. In this embodiment, as the present invention, the depressions 139 are formed on the external surface of the developing sleeve 132 composed of aluminum alloy having an external diameter of 18 mm, by driving the surface treatment device 1, under a condition that the end mill 21 having an external diameter of 6 mm is used, wherein the rotating number of the developing sleeve 132 is 400 rpm, the rotating number of the end mill 21 is 14100 rpm, and the moving speed of the end mill 21 along the longitudinal direction of the developing sleeve 132 is 1 mm/rev.

Further, in the present invention, the depressions 139 are formed on the external surface of the developing sleeve 132 in a spiral manner so that the cross section of each of the depressions 139 is formed to a circular shape of which the curvature radius is 0.4 mm, the cross section of the developing sleeve 132 along the longitudinal direction thereof is formed to a circular shape of which curvature radius is 3.0 mm, the interval between the two depressions 139 along the circumferential direction of the developing sleeve 132 is 0.40 mm, the interval between the two depressions 139 along the longitudinal direction of the developing sleeve 132 is 2.0 mm, and the ends of the two depressions 139 which are adjacent with each other along the longitudinal direction of the developing sleeve are overlapped with each other.

FIG. 31 shows the variation in width and length of each of the depressions 139 to the variation in depth of each of the depressions 139 wherein the depressions 139 are not overlapped with each other, according to the present invention. FIG. 30 shows the variation in volume of each of the depressions 139 to the variation in depth of each of the depressions 139 wherein the depressions 139 are not overlapped with each other, according to the present invention. FIG. 32 shows the variation in volume of each of the depressions 139 per each external surface area of 100 $mm^2$ to the variation in depth of each of the depressions 139 wherein the depressions 139 are not overlapped with each other, according to the present invention. FIG. 32 shows the developing sleeve that has conventionally been used in which 100 grooves are formed on the external surface and the developing sleeve in which the grooves are formed so that they are arranged in a non-overlapped manner with each other as in the Comparative Example 1, the developing sleeve in which grooves are formed on the external surface so that they are arranged in a non-overlapped manner with each other as in the Comparative Example 2. According to FIGS. 14 to 16, it was made clear that the depressions 139 each having a predetermined size are obtained by using the above-mentioned surface treatment device 1. Further, according to FIG. 31, it was made clear that, in the present invention as compared with the Comparative Example 2, the variation in volume of each of the depressions 139 to the variation in depth, that is to say, the variation in the conveying amount of the developer 126 to the variation in size of each of the depressions 139 is small.

Although in the above-mentioned first embodiment the ends of the two depressions 139 which are adjacent with each other along the longitudinal direction of the developing sleeve 132 are overlapped with each other and in the above-mentioned second embodiment the ends of the two depressions 139 which are adjacent with each other along the circumferential direction of the developing sleeve 132 are overlapped with each other, in the present invention, of course, the ends of the two depressions 139 which are adjacent with each other along the longitudinal direction of the developing sleeve 132 may be overlapped with each other and in the above-mentioned second embodiment the ends of the two depressions 139 which are adjacent with each other along the circumferential direction of the developing sleeve 132 may be overlapped with each other.

Meanwhile, the present invention is not limited to the above-described embodiments. Namely, the present invention can be executed in various modified manners without departing from the scope of the present invention as claimed.

What is claimed is:

1. A development roller comprising:

a magnet roller, and a developing sleeve which contains the magnet roller and is configured to hold a developer on an external surface thereof by means of a magnetic force of the magnet roller, wherein a large number of depressions are formed on the external surface of the developing sleeve in a regular manner so that both ends of the depressions which are adjacent with each other along at least one direction of the longitudinal and circumferential directions of the developing sleeve directly overlap with each other, each of the depressions being formed in a circular shape or an oval shape, viewed along a radial direction.

2. The development roller as claimed in claim 1, wherein the depressions are formed on the external surface of the developing sleeve so that both ends of the depressions which are adjacent with each other along the longitudinal direction of the developing sleeve overlap with each other and both ends of the depressions which are adjacent with each other along the circumferential direction of the developing sleeve are spaced from each other.

3. The development roller as claimed in claim 1, wherein the depressions are formed on the external surface of the developing sleeve so that both ends of the depressions which are adjacent with each other along the longitudinal direction of the developing sleeve are spaced from each other and both ends of the depressions which are adjacent with each other along the circumferential direction of the developing sleeve overlap with each other.

4. The development roller as claimed in claim 1, wherein the depressions are formed in an oval shape, viewed along a radial direction, and arranged so that the longitudinal direction of the depressions is parallel to the longitudinal direction of the developing sleeve.

5. The development roller as claimed in claim 1, wherein a cross section of each of the depressions along the circumferential direction of the developing sleeve is formed in a V shape and a cross section of each of the depressions along the circumferential direction of the developing sleeve is formed in an arc shape.

6. The development roller as claimed in claim 1, wherein a cross section of each of the depressions along the circumferential direction of the developing sleeve is formed in an arc shape and a cross section of each of the depressions along the longitudinal direction is formed in a V shape.

7. The development roller as claimed in claim 1, wherein both ends of the depressions which are adjacent with each other in the circumferential direction of the developing sleeve are arranged at a position which is offset along the longitudinal direction of the developing sleeve.

8. The development roller as claimed in claim 1, wherein the depressions are arranged on the external surface of the developing sleeve in a spiral manner.

9. The development roller as claimed in claim 1, wherein each volume of the depressions is formed in a gradually increasing manner from a center of the developing sleeve along the longitudinal direction thereof toward both ends thereof in the same direction.

10. The development roller as claimed in claim 9, wherein each depth of the depressions is formed in a gradually increasing manner from a center of the developing sleeve along the longitudinal direction thereof toward both ends thereof in the same direction.

11. The development roller as claimed in claim 10, wherein each area of the depressions viewed from the top is formed in a gradually increasing manner from a center of the developing sleeve along the longitudinal direction thereof toward both ends thereof in the same direction.

12. The development roller as claimed in claim 1, wherein each of the depressions is a depression that is formed by machining on the external surface of the developing sleeve by means of a rotating tool which is rotated around the axis of rotation of the developing sleeve.

13. The development roller as claimed in claim 12, wherein each of the depressions is a depression that is formed by relatively moving both the rotating tool and the developing sleeve along the longitudinal direction of the developing sleeve, while the developing sleeve arranged in a state crossing the longitudinal axis of the rotating tool is rotated around the longitudinal axis thereof.

14. A developing device comprising the development roller as claimed in claim 13.

15. The development roller as claimed in claim 1, wherein in a case that two depressions amongst the depressions formed on the external surface of the developing sleeve directly overlap with each other, said two depressions overlap in the longitudinal direction of the developing sleeve and overlap also in the circumferential direction of the developing sleeve.

16. A process cartridge comprising at least a developing device, the developing device including a development roller that comprises:

a magnet roller, and a developing sleeve which contains the magnet roller and is configured to hold a developer on an external surface thereof by means of a magnetic force of the magnet roller, wherein a large number of depressions are formed on the external surface of the developing sleeve in a regular manner so that both ends of the depressions which are adjacent with each other along at least one direction of the longitudinal and circumferential directions of the developing sleeve directly overlap with each other, each of the depressions being formed in a circular shape or an oval shape, viewed along a radial direction.

17. An image forming device at least comprising a photoconductive drum, an electrically charging device, and a developing device including a development roller that comprises:

a magnet roller, and a developing sleeve which contains the magnet roller and is configured to hold a developer on an external surface thereof by means of a magnetic force of the magnet roller, wherein a large number of depressions are formed on the external surface of the developing sleeve in a regular manner so that both ends of the depressions which are adjacent with each other along at least one direction of the longitudinal and circumferential directions of the developing sleeve directly overlap with each other, each of the depressions being formed in a circular shape or an oval shape, viewed along a radial direction.

* * * * *